US009870749B2

(12) United States Patent
Yoo et al.

(10) Patent No.: US 9,870,749 B2
(45) Date of Patent: Jan. 16, 2018

(54) DISPLAY DEVICE

(71) Applicant: LG Display Co., Ltd., Seoul (KR)

(72) Inventors: Seungjin Yoo, Gyeonggi-do (KR); Wookyu Sang, Gyeonggi-do (KR); Ooksang Yoo, Daejeon (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/833,336

(22) Filed: Aug. 24, 2015

(65) Prior Publication Data

US 2016/0078826 A1 Mar. 17, 2016

(30) Foreign Application Priority Data

Sep. 17, 2014 (KR) ..... 10-2014-0123382

(51) Int. Cl.
*G09G 3/36* (2006.01)

(52) U.S. Cl.
CPC ..... *G09G 3/3688* (2013.01); *G09G 3/3648* (2013.01); *G09G 3/3614* (2013.01); *G09G 2300/0452* (2013.01); *G09G 2310/0224* (2013.01); *G09G 2310/0297* (2013.01); *G09G 2310/08* (2013.01); *G09G 2330/023* (2013.01)

(58) Field of Classification Search
CPC .. G09G 3/3688; G09G 3/3648; G09G 3/3614; G09G 3/3233; G09G 3/3696; G09G 3/2092; G09G 3/22; G09G 3/3225; G09G 3/3258; G09G 2330/021; G09G 2300/0452; G09G 2310/027; G09G 2310/0297; G06F 3/044; G06F 3/0412
See application file for complete search history.

(56) References Cited

U.S. PATENT DOCUMENTS 6,614,498 B1 * 9/2003 Tanaka ..... G02F 1/133514 349/106
6,963,328 B2 * 11/2005 Kang ..... G09G 3/3614 345/100
7,030,844 B2 * 4/2006 Kang ..... G09G 3/3688 345/100

(Continued)

FOREIGN PATENT DOCUMENTS

CN 103728746 A 4/2014

OTHER PUBLICATIONS

European Search Report issued in European Patent Application No. 15184685.4 dated Apr. 13, 2016.

(Continued)

*Primary Examiner* — Dismery Mercedes
(74) *Attorney, Agent, or Firm* — Morgan, Lewis & Bockius LLP

(57) ABSTRACT

A display device includes a pixel array having a plurality of pixels arranged in a matrix form based on a crossing structure of data lines and gate lines, a data driver having a plurality of output channels and configured to output a data voltage, a multiplexer configured to distribute the data voltage output from the data driver to the data lines in response to first and second control signals, and a gate driver configured to output a gate pulse synchronized with the data voltage in a non-sequential manner. The first and second control signals are in antiphase, and a switching cycle of the first and second control signals is one horizontal period or two horizontal periods.

19 Claims, 19 Drawing Sheets

(56) References Cited

U.S. PATENT DOCUMENTS 8,031,153 B2 * 10/2011 Kang ..... G09G 3/3648 345/209
8,344,984 B2 * 1/2013 Min ..... G09G 3/3648 345/209
8,922,603 B2 * 12/2014 Yonemaru ..... G09G 3/3648 345/100
9,262,974 B2 * 2/2016 Lee ..... G09G 3/3607
9,343,022 B2 * 5/2016 Park ..... G09G 3/3607
9,361,849 B2 * 6/2016 Park ..... G09G 3/3696
2006/0170625 A1 * 8/2006 Kim ..... G09G 3/3225 345/76
2008/0150868 A1 * 6/2008 Chen ..... G09G 3/364 345/95
2008/0259016 A1 * 10/2008 Tanaka ..... G09G 3/3688 345/90
2008/0266225 A1 * 10/2008 Kim ..... G09G 3/3648 345/88
2008/0278466 A1 * 11/2008 Joo ..... G09G 3/3614 345/205
2010/0156947 A1 * 6/2010 Moon ..... G09G 3/3648 345/690
2010/0302215 A1 12/2010 Tsai et al.
2010/0315402 A1 12/2010 Hashimoto
2011/0169797 A1 * 7/2011 Song ..... G09G 3/3614 345/209
2011/0285950 A1 * 11/2011 Su ..... G02F 1/136286 349/139
2012/0098871 A1 * 4/2012 Park ..... G09G 3/3607 345/690
2012/0120034 A1 * 5/2012 Lee ..... G09G 3/3677 345/205
2012/0293536 A1 * 11/2012 Yonemaru ..... G09G 3/3648 345/589
2013/0141320 A1 * 6/2013 Kim ..... G09G 3/3685 345/92
2013/0235026 A1 9/2013 Yamamoto
2014/0218347 A1 * 8/2014 Lee ..... G02F 1/136286 345/211
2014/0267473 A1 * 9/2014 Washio ..... G09G 3/3688 345/694
2015/0294611 A1 10/2015 Zheng et al.
2015/0339972 A1 * 11/2015 Xu ..... G09G 3/3225 345/206
2016/0049123 A1 * 2/2016 Jeong ..... G09G 3/3607 345/690
2016/0093260 A1 * 3/2016 Watsuda ..... G09G 3/3611 345/87

OTHER PUBLICATIONS

European Search Report issued in European Patent Application No. 15184685.4 dated Dec. 18, 2015.
European Office Action dated Apr. 5, 2017 for the European patent application No. 15184685.4.

* cited by examiner

MUX switching cycle : 2H
Data switching cycle : 4H

DISPLAY DEVICE

This application claims the benefit of Korean Patent Application No. 10-2014-0123382 filed on Sep. 17, 2014, the entire contents of which is incorporated herein by reference for all purposes as if fully set forth herein.

BACKGROUND OF THE INVENTION

Field of the Invention

The present disclosure relates to a display device and, more particularly, to a display device in which each pixel is divided into a red subpixel, a green subpixel, a blue subpixel, and a white subpixel.

Discussion of the Related Art

Recently, various flat panel displays, such as a liquid crystal display (LCD), a plasma display panel (PDP), an organic light emitting diode (OLED) display, and an electrophoresis display (EPD), have been developed. The liquid crystal display displays an image by controlling an electric field applied to liquid crystal molecules based on a data voltage. An active matrix liquid crystal display includes a thin film transistor (TFT) in each pixel.

The liquid crystal display includes a liquid crystal display panel, a backlight unit irradiating light onto the liquid crystal display panel, source driver integrated circuits (ICs) for supplying a data voltage to data lines of the liquid crystal display panel, gate driver ICs for supplying gate pulses (or scan pulses) to gate lines (or scan lines) of the liquid crystal display panel, a control circuit for controlling the source driver ICs and the gate driver ICs, and a light source driving circuit for driving light sources of the backlight unit.

The liquid crystal display is being developed to have a white (W) subpixel added to each pixel including a red (R) subpixel, a green (G) subpixel, and a blue (B) subpixel. As described below, such a display device, in which each pixel is divided into the R, G, B, and W subpixels, is referred to as an RGBW type display device. The W subpixel increases luminance of each pixel and decreases luminance of the backlight unit, thereby reducing power consumption of the liquid crystal display.

A multiplexer (MUX) may be installed between the source driver IC and the data lines of the liquid crystal display panel, thereby reducing the cost of the display device. The multiplexer time-divides the data voltage output from the source driver IC and distributes the data voltages to the data lines, thereby reducing the number of output channels of the source driver IC. However, when a high switching frequency is generated and a single color is displayed on the display panel, power consumption of the multiplexer increases. In the invention disclosed herein, the single color may be anyone of red, green, and blue colors.

SUMMARY OF THE INVENTION

Accordingly, the present invention is directed to a display device that substantially obviates one or more of the problems due to limitations and disadvantages of the related art.

An object of the present invention is to provide a display device capable of reducing the number of source driver integrated circuits (ICs) required to drive a display panel.

Another object of the present invention is to provide a display device capable of reducing power consumption.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, a display device comprises a pixel array including pixels arranged in a matrix form based on a crossing structure of data lines and gate lines, a data driver configured to output a data voltage through output channels, a multiplexer configured to distribute the data voltage output from the data driver to the data lines in response to first and second control signals, and a gate driver configured to output a gate pulse synchronized with the data voltage in a non-sequential manner.

The first and second control signals are in antiphase with each other, and a switching cycle of the first and second control signals is one horizontal period or two horizontal periods.

A data switching cycle of the data voltage supplied to the pixel array is N horizontal periods, where N is a positive integer between 4 and 8.

In another aspect, there is a display device comprising a pixel array including pixels arranged in a matrix form based on a crossing structure of data lines and gate lines, a data driver configured to output a data voltage to the data lines through output channels, and a gate driver configured to output a gate pulse synchronized with the data voltage in a non-sequential manner.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention.

It will be understood that when an element is referred to as being "connected with" another element, it can be directly connected with the other element or intervening elements may also be present. In contrast, when an element is referred to as being "directly connected with" another element, there are no intervening elements present.

The terminology used herein is for the purpose of describing particular embodiments only and is not intended to be limiting of the invention, and as used herein, the singular forms "a," "an," and "the" are intended to include the plural forms as well, unless the context clearly indicates otherwise.

A display device according to an exemplary embodiment of the invention may be implemented as a flat panel display capable of representing colors, such as a liquid crystal display (LCD), a plasma display panel (PDP), and an organic light emitting diode (OLED) display. In the following description, the exemplary embodiments of the invention will be described using the liquid crystal display as an example of the flat panel display. Other flat panel displays also may be used. For example, an arrangement of red, green, blue, and white subpixels according to the exemplary embodiment of the invention may be applied to the OLED display.

Reference will now be made in detail to embodiments of the invention, examples of which are illustrated in the accompanying drawings. Wherever possible, the same reference numbers will be used throughout the drawings to refer to the same or like parts. Detailed description of known arts will be omitted if it is determined that the arts can mislead the embodiments of the invention.

Figure 1:
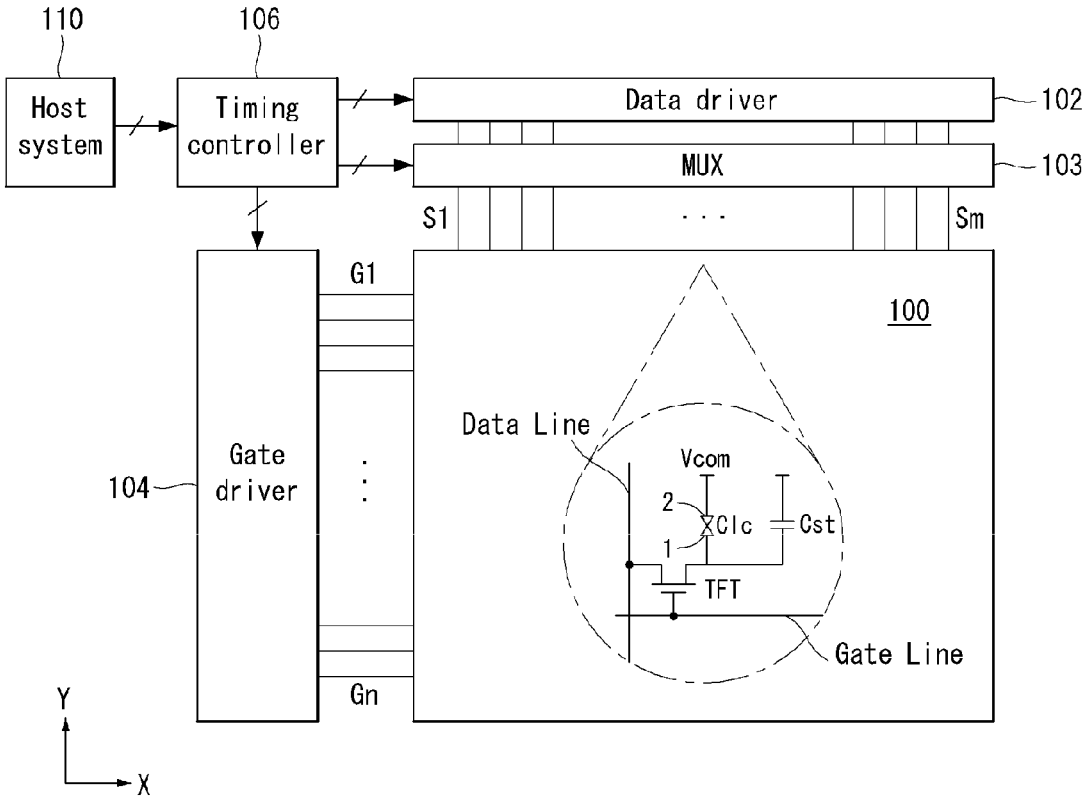
FIG. 1 is a block diagram illustrating a display device according to an exemplary embodiment of the invention.

Referring to FIG. 1, a display device according to an exemplary embodiment of the invention includes a display panel 100 including a pixel array and a display panel driving circuit for writing data of an input image on the display panel 100. A backlight unit for uniformly irradiating light onto the display panel 100 may be disposed under the display panel 100.

The display panel 100 includes an upper substrate and a lower substrate, which are positioned opposite each other with a liquid crystal layer interposed therebetween. The pixel array of the display panel 100 includes pixels arranged in a matrix form based on a crossing structure of data lines S1 to Sm and gate lines G1 to Gn. The lower substrate of the display panel 100 includes the data lines S1 to Sm, the gate lines G1 to Gn, thin film transistors (TFTs), pixel electrodes 1 connected to the TFTs, and storage capacitors Cst connected to the pixel electrodes 1.

Each pixel of the pixel array may be divided into two subpixels each having a different color or four subpixels each having a different color. For example, if a pentile rendering algorithm is applied to the pixel array, each pixel may include two subpixels. Thus, a first pixel may include a red subpixel and a green subpixel, and a second pixel may include a blue subpixel and a white subpixel. In the following description, a red subpixel is referred to as "R subpixel," a green subpixel is referred to as "G subpixel," a blue subpixel is referred to as "B subpixel," and a white subpixel is referred to as "W subpixel." When each pixel is divided into four subpixels, each pixel includes R, G, B, and W subpixels.

A data switching cycle of a data voltage supplied to the pixels of the pixel array lengthens to N horizontal periods due to the non-sequential supply of a gate pulse, where N is a positive integer between 4 and 8. The data switching cycle is a period, in which the data voltages of two colors are supplied. As the data switching cycle lengthens, the amount of current consumed by a source driver integrated circuit (IC) decreases, thereby reducing the power consumption.

Each subpixel adjusts a transmission amount of light using liquid crystal molecules driven by a voltage difference between the pixel electrode 1 charged to the data voltage through the TFT and a common electrode 2, to which a common voltage Vcom is supplied.

The TFTs formed on the lower substrate of the display panel 100 may be implemented as an amorphous silicon (a-Si) TFT, a LTPS (Low Temperature Poly-Silicon) TFT, an oxide TFT, and the like. The TFTs are connected to the pixel electrodes 1 of the subpixels, respectively.

A color filter array is formed on the upper substrate of the display panel 100 and includes black matrixes and color filters. In a vertical electric field driving manner such as a twisted nematic (TN) mode and a vertical alignment (VA) mode, the common electrode 2 may be formed on the upper substrate. In a horizontal electric field driving manner such as an in-plane switching (IPS) mode and a fringe field switching (FFS) mode, the common electrode 2 may be formed on the lower substrate along with the pixel electrodes 1. Polarizing plates are attached to the upper substrate and the lower substrate of the display panel 100, respectively. Alignment layers for setting a pre-tilt angle of liquid crystals are formed on the upper substrate and the lower substrate of the display panel 100, respectively.

The display device according to the exemplary embodiment of the invention may be implemented as any type liquid crystal display including a transmissive liquid crystal display, a transflective liquid crystal display, and a reflective liquid crystal display. The transmissive liquid crystal display and the transflective liquid crystal display require the backlight unit. The backlight unit may be implemented as a direct type backlight unit or an edge type backlight unit.

The display panel driving circuit writes the data of the input image on the pixels. The data written on the pixels includes R data, G data, B data, and W data. The display panel driving circuit includes a data driver 102, a gate driver 104, and a timing controller 106. A multiplexer (MUX) 103 may be disposed between the data driver 102 and the data lines S1 to Sm.

The data driver 102 includes a plurality of source driver ICs. Output channels of the source driver ICs may be connected to the data lines S1 to Sm of the pixel array or may be connected to the data lines S1 to Sm through the multiplexer 103. The source driver ICs receive digital video data of the input image from the timing controller 106. The digital video data transmitted to the source driver ICs includes R data, G data, B data, and W data. The source driver ICs convert the RGBW digital video data of the input image into positive and negative gamma compensation voltages under the control of the timing controller 106 and output positive and negative data voltages. An output voltage of the source driver ICs is supplied to the data lines S1 to Sm.

Each source driver IC inverts a polarity of the data voltage to be supplied to the pixels under the control of the timing controller 106 and outputs the data voltage to the data lines S1 to Sm. The source driver ICs may maintain a polarity of the data voltage supplied to the data lines S1 to Sm during one frame period, and then may invert the polarity of the data voltage in each frame. For example, a polarity of the data voltage supplied through a first data line is maintained at a first polarity during a first frame period and then is inverted into a second polarity during a second frame period. Thus, the data voltage is maintained at the same polarity during one frame period. A polarity of the data voltage supplied through a second data line is maintained at the second polarity during the first frame period and then is inverted into the first polarity during the second frame period. That is, the data voltage is maintained at the same polarity during one frame period. As described above, because the polarity of the data voltage does not change during one frame period, power consumption of the source driver ICs and an amount of heat generated by the source driver ICs are reduced. The data voltages output from the source driver ICs through the same data line have the same polarity. However, the horizontally adjacent subpixels in the pixel array have the reverse polarities.

The multiplexer 103 time-division supplies the data voltage input from the source driver IC to the data lines S1 to Sm under the control of the timing controller 106. When a 1-to-2 multiplexer is used, the multiplexer 103 time-divides the data voltage input through one output channel of the source driver IC and supplies the data voltages to the two data lines. Thus, the number of source driver ICs required to drive the display panel 100 is reduced to one half through the 1-to-2 multiplexer. The multiplexer 103 may be embedded in the source driver IC.

The gate driver 104 supplies a gate pulse to the gate lines G1 to Gn under the control of the timing controller 106. The gate pulse is not sequentially supplied to the gate lines G1, G2, G3, G4 . . . Gn−1, and Gn in the order named and is non-sequentially supplied to the gate lines. This is to reduce a data switching cycle of the data voltage supplied to the pixel array by successively arranging four or more data of the same color.

The timing controller 106 converts RGB data of the input image received from a host system 110 into RGBW data and transmits the RGBW data to the data driver 102. An interface for data transmission between the timing controller 106 and the source driver ICs of the data driver 102 may use a mini low voltage differential signaling (LVDS) interface or an embedded panel interface (EPI).

The timing controller 106 receives timing signals synchronized with the data of the input image from the host system 110. The timing signals include a vertical sync signal Vsync, a horizontal sync signal Hsync, a data enable signal DE, and a main clock DCLK. The timing controller 106 controls operation timings of the data driver 102, the gate driver 104, and the multiplexer 103 based on the timing signals Vsync, Hsync, DE, and DCLK received along with pixel data of the input image. The timing controller 106 transmits a polarity control signal for controlling polarities of the pixel array to each of the source driver ICs of the data driver 102. The mini LVDS interface is used to transmit the polarity control signal through a separate control line. The EPI is an interface technology, which encodes polarity control information to a control data packet transmitted between a clock training pattern for clock and data recovery (CDR) and an RGBW data packet and transmits the polarity control information to each of the source driver ICs of the data driver 102.

The timing controller 106 may convert the RGB data of the input image into the RGBW data using a white gain calculation algorithm. The white gain calculation algorithm may use any known algorithm. The host system 110 may be implemented as one of a television system, a set-top box, a navigation system, a DVD player, a Blu-ray player, a personal computer (PC), a home theater system, and a phone system.

Figure 2:
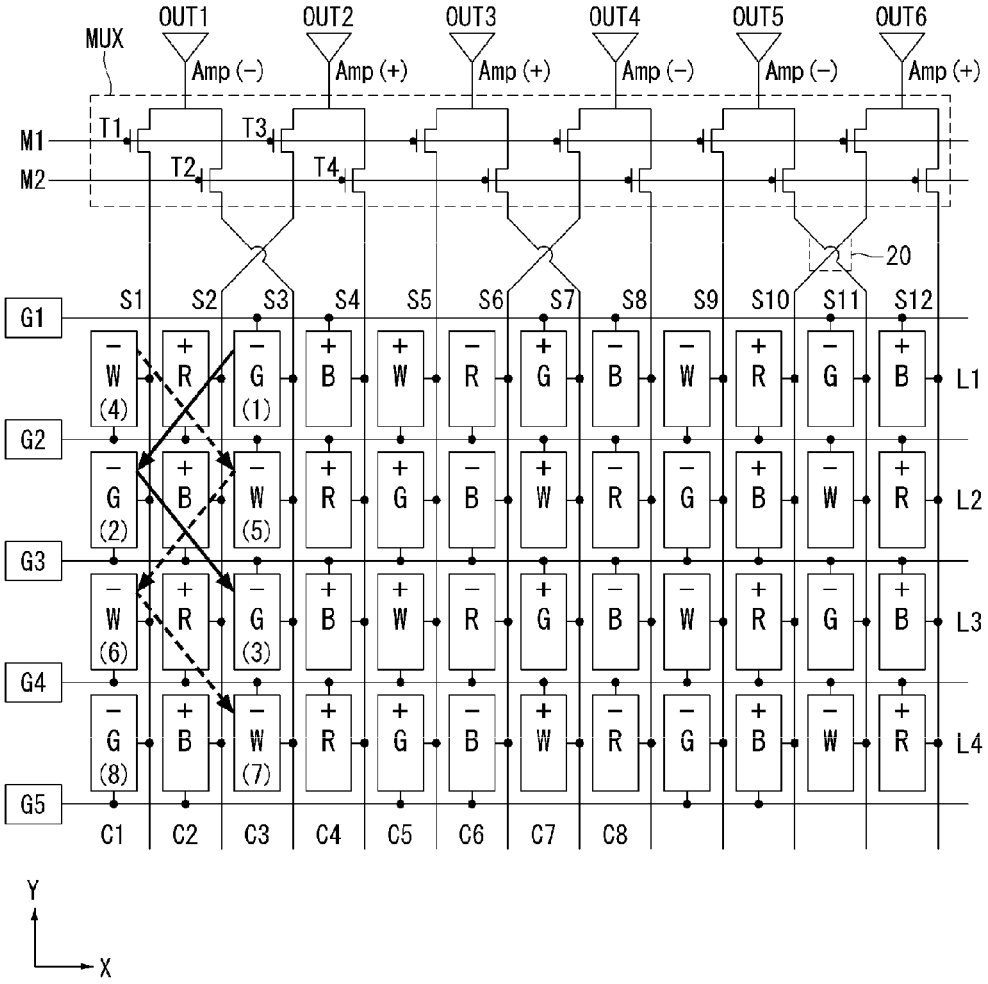
FIG. 2 is a circuit diagram illustrating a multiplexer and a pixel array according to a first embodiment of the invention.
Figure 3A:
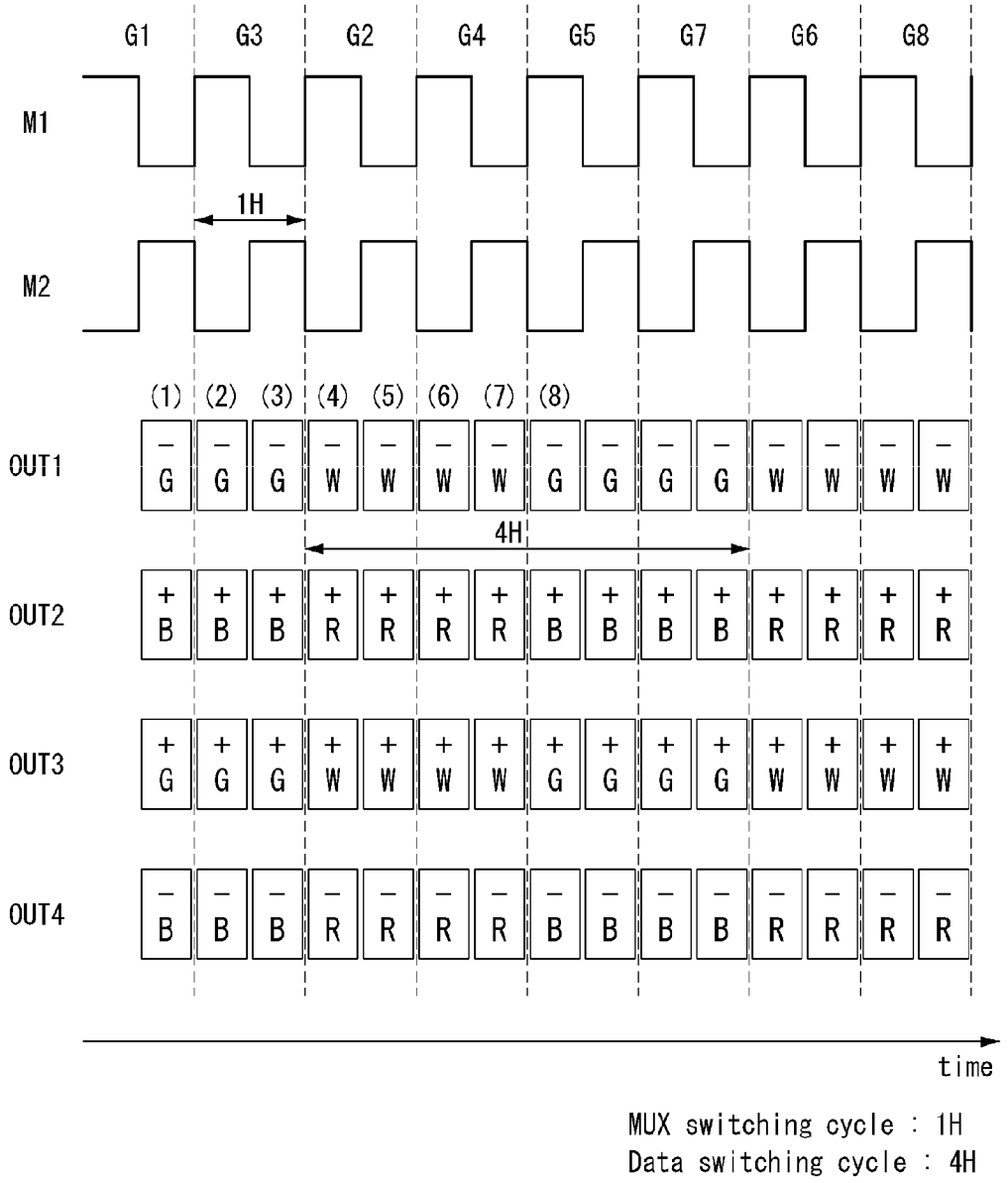
FIGS. 3A and 3B are waveform diagrams illustrating a switching cycle of the multiplexer shown in FIG. 2 and a switching cycle of data thereof.
Figure 3B:
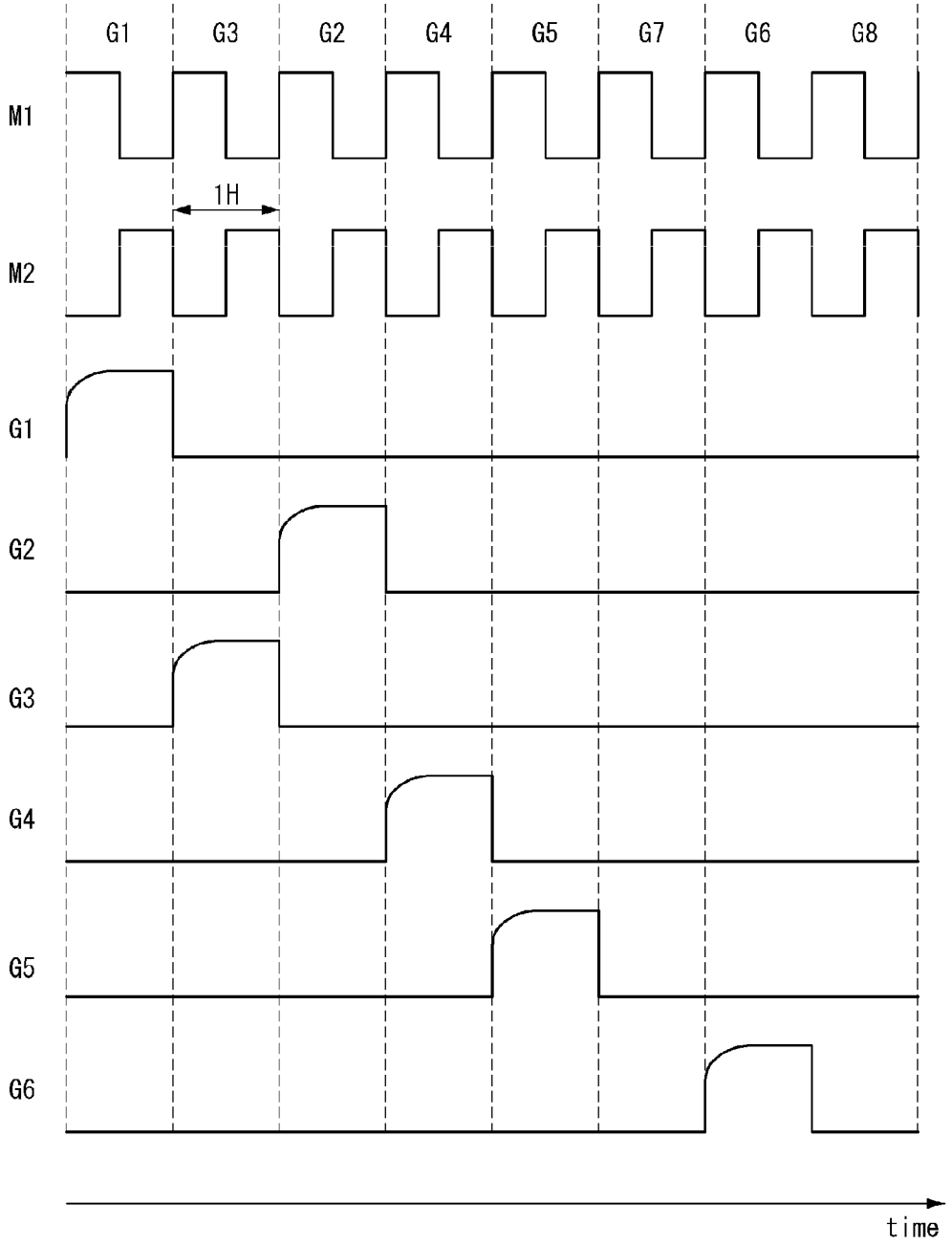

FIG. 2 is a circuit diagram illustrating a multiplexer and a pixel array according to a first exemplary embodiment of the invention. FIGS. 3A and 3B are waveform diagrams illustrating a switching cycle of the multiplexer shown in FIG. 2 and a switching cycle of data. As shown in FIG. 2, "OUT1" to "OUT6" are output channels of the source driver IC. "Amp (−)" is a buffer amplifier connected to the output channels OUT1 to OUT6 of the source driver IC and supplies a negative data voltage to the multiplexer 103. "Amp(+)" is a buffer amplifier connected to the output channels OUT1 to OUT6 of the source driver IC and supplies a positive data voltage to the multiplexer 103.

Referring to FIGS. 2 to 3B, the multiplexer 103 (MUX) includes a plurality of switches T1 to T4. Control signals M1 and M2 are supplied to gates of the switches T1 to T4. Drains of the switches T1 to T4 are connected to the output channels OUT1 to OUT6 of the source driver IC, and sources of the switches T1 to T4 are connected to the data lines S1 to S12.

The multiplexer 103 time-divides the data voltage output from the source driver IC in response to the first and second control signals M1 and M2 from the timing controller 106 (of FIG. 1) and distributes the data voltages to the data lines S1 to S12. The first and second control signals M1 and M2 are generated in antiphase with each other. That is, a phase of the second control signal M2 is more delayed than a phase of the first control signal M1 by 180°. The second control signal M2 may be generated through a method for inverting the first control signal M1 using an inverter. A switching cycle of the first and second control signals M1 and M2 is one horizontal period 1H. The one horizontal period 1H is a time required to apply data to the pixels disposed on one horizontal line of the pixel array.

The first switch T1 is connected between the first output channel OUT1 and the first data line S1 and supplies the data voltage from the first output channel OUT1 to the first data line S1 in response to the first control signal M1. The second switch T2 is connected between the first output channel OUT1 and the third data line S3 and supplies the data voltage from the first output channel OUT1 to the third data line S3 in response to the second control signal M2. The first and second switches T1 and T2 alternately turn on.

The third switch T3 is connected between the second output channel OUT2 and the second data line S2 and supplies the data voltage from the second output channel OUT2 to the second data line S2 in response to the first control signal M1. The fourth switch T4 is connected between the second output channel OUT2 and the fourth data line S4 and supplies the data voltage from the second output channel OUT2 to the fourth data line S4 in response to the second control signal M2. The third and fourth switches T3 and T4 alternately turn on.

The second and third switches T2 and T3 and the second and third data lines S2 and S3 are connected crosswise. For this, link lines 20 (of FIG. 2) connecting the second and third switches T2 and T3 to the second and third data lines S2 and S3 cross each other with an insulating layer interposed therebetween.

On odd-numbered horizontal lines L1 and L3 of the pixel array, colors of subpixels are arranged from the left in order of W, R, G, and B. On even-numbered horizontal lines L2 and L4 of the pixel array, colors of subpixels are arranged from the left in order of G, B, W, and R. On a first vertical line C1, colors of subpixels are arranged from the upper side in order of W, G, W, and G. On a second vertical line C2, colors of subpixels are arranged from the upper side in order of R, B, R, and B. On a third vertical line C3, colors of subpixels are arranged from the upper side in order of G, W, G, and W. On a fourth vertical line C4, colors of subpixels are arranged from the upper side in order of B, R, B, and R. The pixel structure and the color arrangement of the first to fourth vertical lines C1 to C4 are substantially the same as fifth to eighth vertical lines C5 to C8. Polarities of the subpixels on the first to fourth vertical lines C1 to C4 are opposite to polarities of subpixels on the fifth to eighth vertical lines C5 to C8.

On the first horizontal line L1, a first subpixel −W is connected to the second gate line G2 and the first data line S1 and receives the data voltage from the first data line S1 in response to the gate pulse from the second gate line G2. A second subpixel +R is connected to the second gate line G2 and the second data line S2 and receives the data voltage from the second data line S2 in response to the gate pulse from the second gate line G2. A third subpixel −G is connected to the first gate line G1 and the third data line S3 and receives the data voltage from the third data line S3 in response to the gate pulse from the first gate line G1. A fourth subpixel +B is connected to the first gate line G1 and the fourth data line S4 and receives the data voltage from the fourth data line S4 in response to the gate pulse from the first gate line G1.

On the second horizontal line L2, a first subpixel −G is connected to the third gate line G3 and the first data line S1 and receives the data voltage from the first data line S1 in response to the gate pulse from the third gate line G3. A second subpixel +B is connected to the third gate line G3 and the second data line S2 and receives the data voltage from the second data line S2 in response to the gate pulse from the third gate line G3. A third subpixel −W is connected to the second gate line G2 and the third data line S3 and receives the data voltage from the third data line S3 in response to the gate pulse from the second gate line G2. A fourth subpixel +R is connected to the second gate line G2 and the fourth data line S4 and receives the data voltage from the fourth data line S4 in response to the gate pulse from the second gate line G2.

As shown in FIGS. 3A and 3B, when the gate pulse is synchronized with the first and second control signals M1 and M2 and is supplied to the first to fourth gate lines G1 to G4 in order of G1, G3, G2, and G4, the data voltage of a first color is successively supplied to four subpixels during two horizontal periods, and then the data voltage of a second color is successively supplied to other four subpixels during next two horizontal periods. In FIGS. 2 and 3A, (1) through (8) and the arrow indicate the charge order of the data voltage to the subpixels, which are controlled in the application order of the gate pulse. Thus, a switching cycle of data is four horizontal periods 4H.

Figure 4:
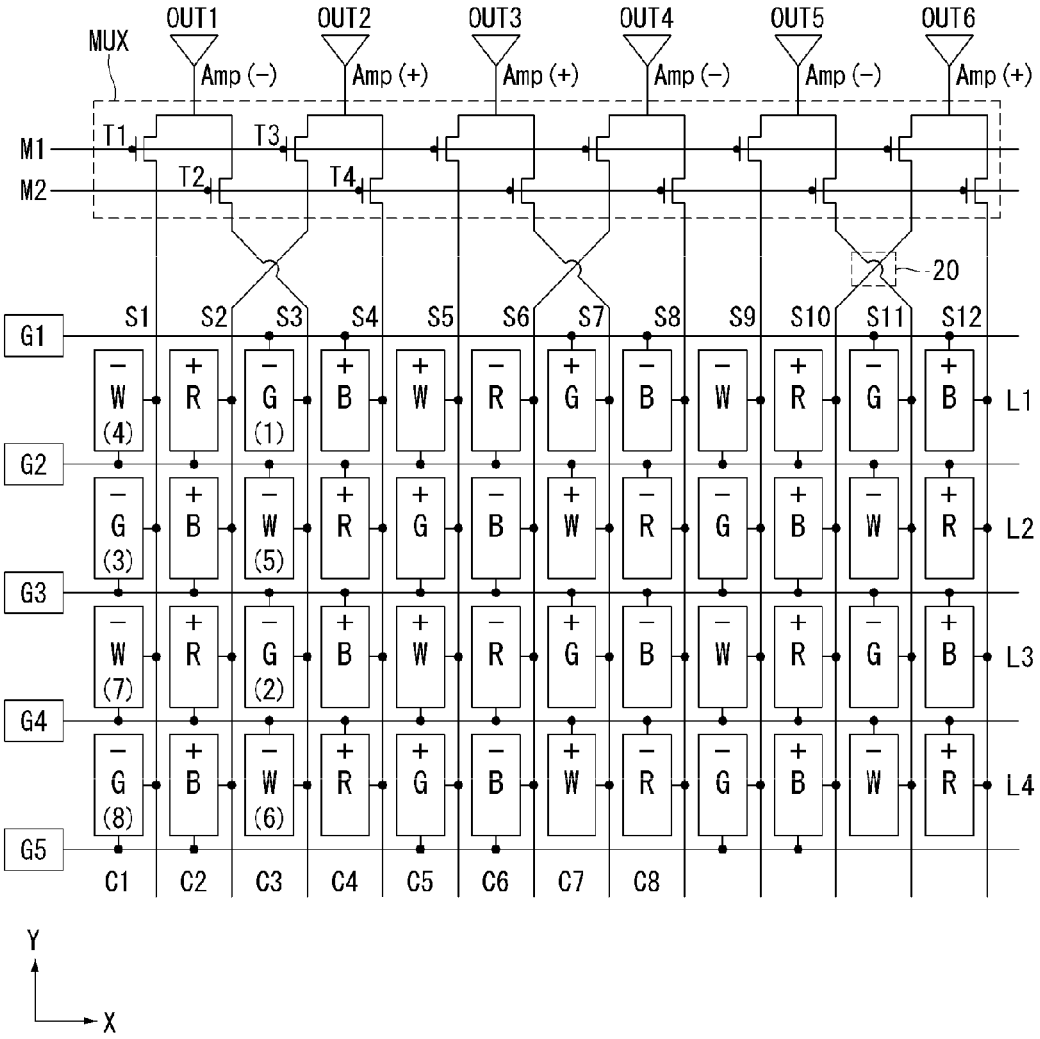
FIG. 4 is a circuit diagram illustrating a multiplexer and a pixel array according to a second embodiment of the invention.
Figure 5A:
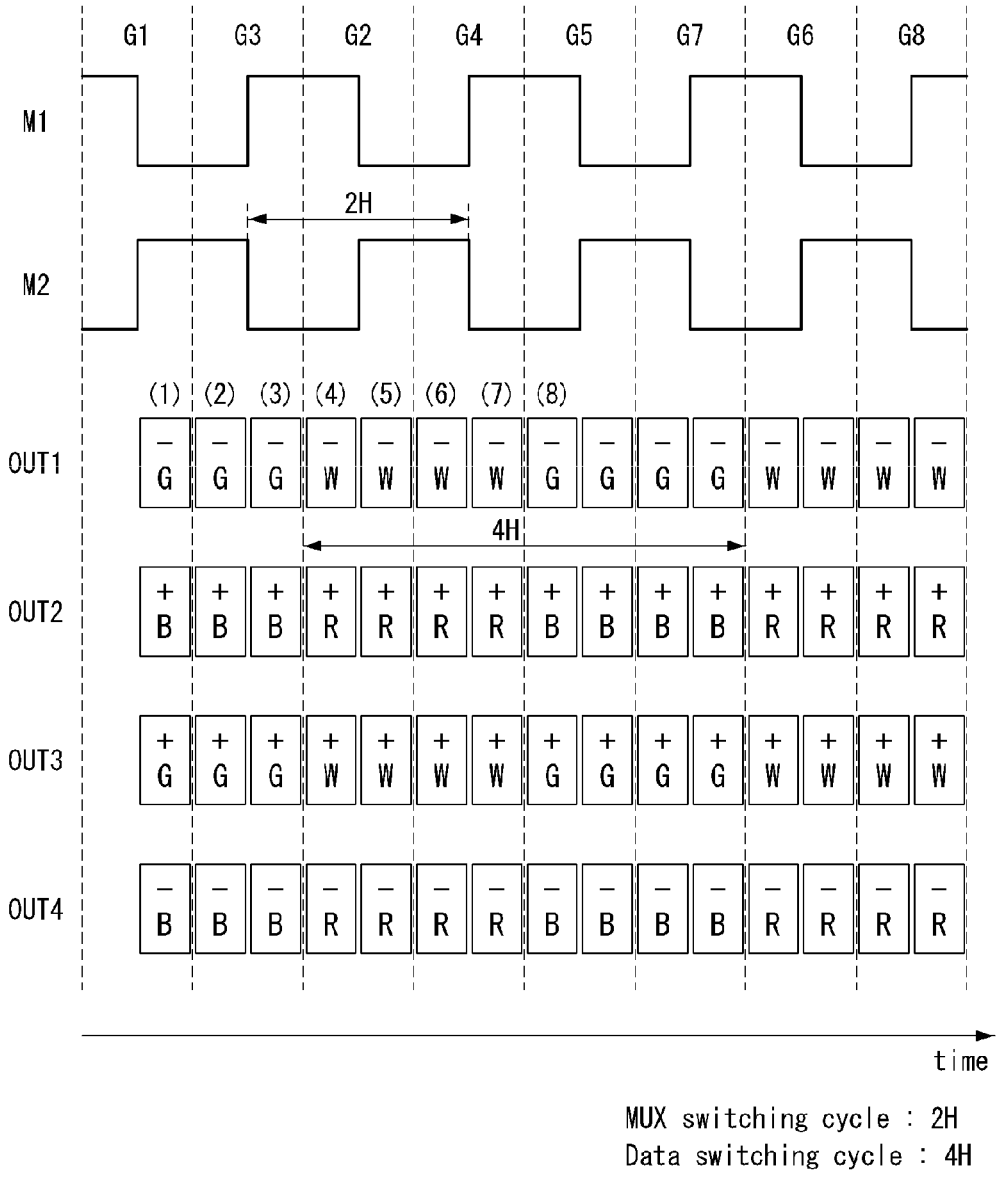
FIGS. 5A and 5B are waveform diagrams illustrating a switching cycle of the multiplexer shown in FIG. 4 and a switching cycle of data thereof.
Figure 5B:
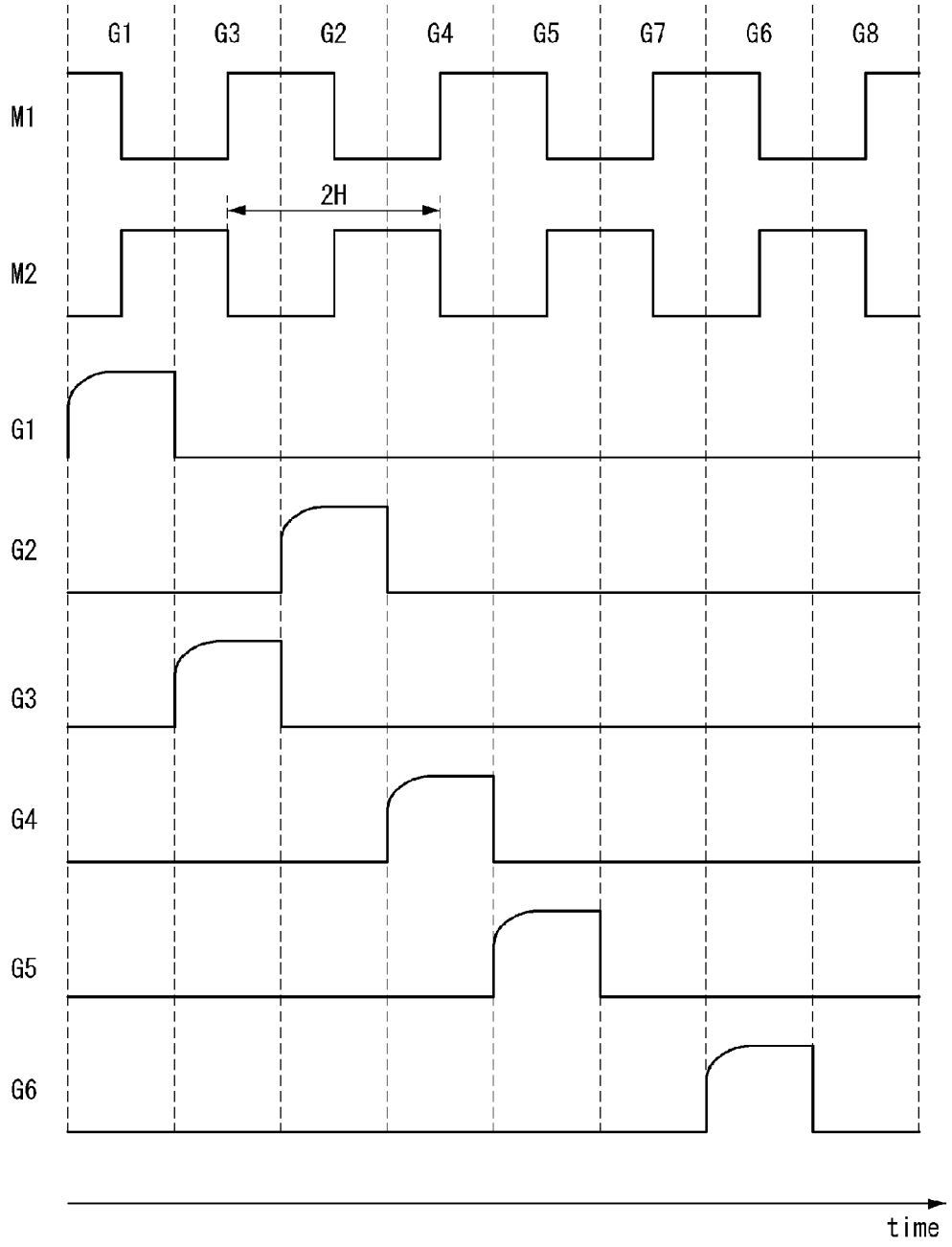

FIG. 4 is a circuit diagram illustrating a multiplexer and a pixel array according to a second exemplary embodiment of the invention. FIGS. 5A and 5B are waveform diagrams illustrating a switching cycle of the multiplexer shown in FIG. 4 and a switching cycle of data.

Referring to FIGS. 4 to 5B, the multiplexer 103 (MUX) time-divides the data voltage output from the source driver IC in response to first and second control signals M1 and M2 from the timing controller 106 and distributes the data voltages to the data lines S1 to S12. The first and second control signals M1 and M2 may be generated in antiphase with each other. A switching cycle of the first and second control signals M1 and M2 is two horizontal periods 2H.

A first switch T1 is connected between a first output channel OUT1 and the first data line S1 and supplies the data voltage from the first output channel OUT1 to the first data line S1 in response to the first control signal M1. A second switch T2 is connected between the first output channel OUT1 and the third data line S3 and supplies the data voltage from the first output channel OUT1 to the third data line S3 in response to the second control signal M2. The first and second switches T1 and T2 alternately turn on.

A third switch T3 is connected between a second output channel OUT2 and the second data line S2 and supplies the data voltage from the second output channel OUT2 to the second data line S2 in response to the first control signal M1. A fourth switch T4 is connected between the second output channel OUT2 and the fourth data line S4 and supplies the data voltage from the second output channel OUT2 to the fourth data line S4 in response to the second control signal M2. The third and fourth switches T3 and T4 alternately turn on.

The second and third switches T2 and T3 and the second and third data lines S2 and S3 are connected crosswise. For this, link lines 20 (of FIG. 4) connecting the second and third switches T2 and T3 to the second and third data lines S2 and S3 cross each other with an insulating layer interposed therebetween.

On odd-numbered horizontal lines L1 and L3 of a pixel array, colors of subpixels are arranged from the left in order of W, R, G, and B. On even-numbered horizontal lines L2 and L4 of the pixel array, colors of subpixels are arranged from the left in order of G, B, W, and R. On a first vertical line C1, colors of subpixels are arranged from the upper side in order of W, G, W, and G. On a second vertical line C2, colors of subpixels are arranged from the upper side in order of R, B, R, and B. On a third vertical line C3, colors of subpixels are arranged from the upper side in order of G, W, G, and W. On a fourth vertical line C4, colors of subpixels are arranged from the upper side in order of B, R, B, and R. The pixel structure and the color arrangement of the first to fourth vertical lines C1 to C4 are substantially the same as fifth to eighth vertical lines C5 to C8. Polarities of the subpixels on the first to fourth vertical lines C1 to C4 are opposite to polarities of subpixels on the fifth to eighth vertical lines C5 to C8.

On the first horizontal line L1, a first subpixel −W is connected to the second gate line G2 and the first data line S1 and receives the data voltage from the first data line S1 in response to the gate pulse from the second gate line G2. A second subpixel +R is connected to the second gate line G2 and the second data line S2 and receives the data voltage from the second data line S2 in response to the gate pulse from the second gate line G2. A third subpixel −G is connected to the first gate line G1 and the third data line S3 and receives the data voltage from the third data line S3 in response to the gate pulse from the first gate line G1. A fourth subpixel +B is connected to the first gate line G1 and the fourth data line S4 and receives the data voltage from the fourth data line S4 in response to the gate pulse from the first gate line G1.

On the second horizontal line L2, a first subpixel −G is connected to the third gate line G3 and the first data line S1 and receives the data voltage from the first data line S1 in response to the gate pulse from the third gate line G3. A second subpixel +B is connected to the third gate line G3 and the second data line S2 and receives the data voltage from the second data line S2 in response to the gate pulse from the third gate line G3. A third subpixel −W is connected to the second gate line G2 and the third data line S3 and receives the data voltage from the third data line S3 in response to the gate pulse from the second gate line G2. A fourth subpixel +R is connected to the second gate line G2 and the fourth data line S4 and receives the data voltage from the fourth data line S4 in response to the gate pulse from the second gate line G2.

As shown in FIGS. 5A and 5B, when the gate pulse is synchronized with the first and second control signals M1 and M2 and is supplied to the first to fourth gate lines G1 to G4 in order of G1, G3, G2, and G4, the data voltage of a first color is successively supplied to four subpixels during two horizontal periods, and then the data voltage of a second color is successively supplied to other four subpixels during next two horizontal periods. In FIGS. 4 and 5A, (1) through (8) indicate the charge order of the data voltage to the subpixels, which are controlled in the application order of the gate pulse. Thus, a switching cycle of data is four horizontal periods 4H.

Figure 6A:
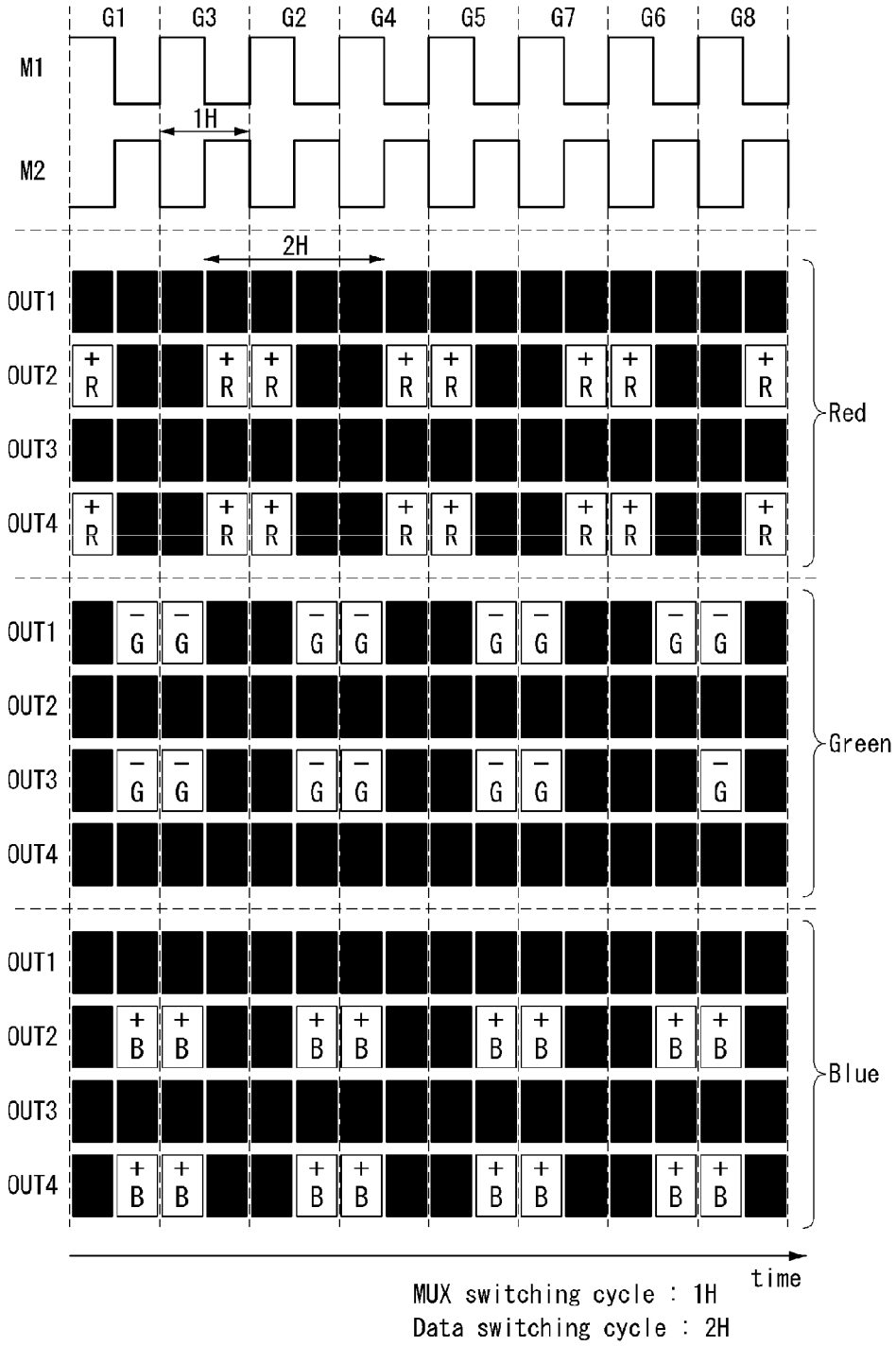
FIGS. 6A and 6B are diagrams comparing a switching cycle of the multiplexer shown in FIG. 4 and a switching cycle of data with a comparative example.
Figure 6B:
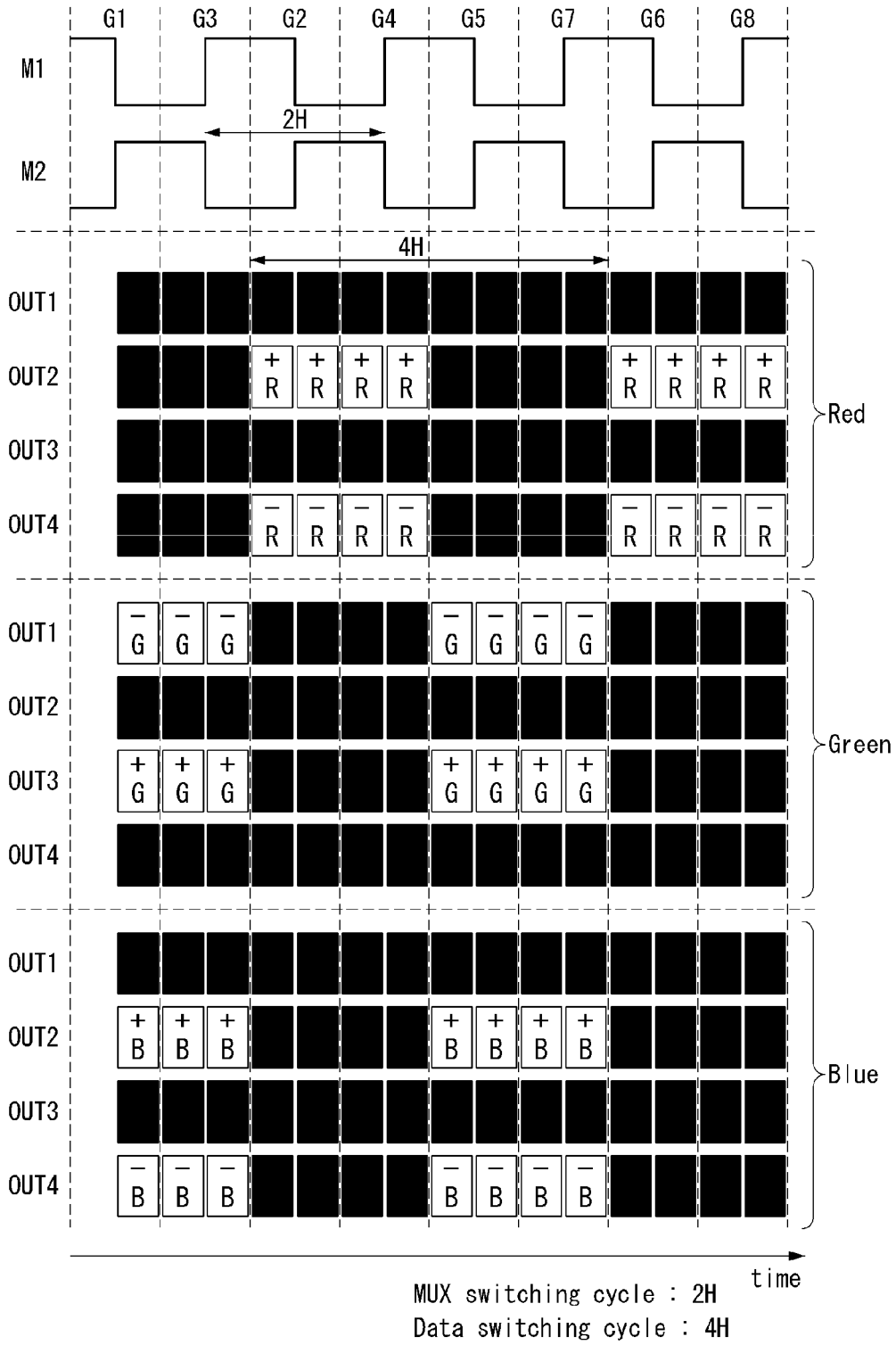

FIGS. 6A and 6B are diagrams comparing a switching cycle of the multiplexer (MUX) shown in FIG. 4 and a switching cycle of data with a comparative example. More specifically, FIG. 6A shows the comparative example, in which a MUX switching cycle of the multiplexer 103 is one horizontal period and a switching cycle of data is two horizontal periods when a single color is displayed on the pixel array. FIG. 6B shows a switching cycle of the multiplexer and a switching cycle of data according to the second embodiment of the invention. In FIG. 6B, a MUX switching cycle of the multiplexer 103 is two horizontal periods, and a switching cycle of data is four horizontal periods. In FIG. 6B, a pattern of the same single color as the comparative example is displayed on the pixel array. The MUX switching cycle of the multiplexer 103 and the switching cycle of data according to the embodiment of the invention are two times longer than the comparative example. Thus, the exemplary embodiment of the invention can reduce the number of switching operations of the data driver 102 and the number of switching operations of the multiplexer 103 to about 50% compared to the comparative example, thereby substantially reducing power consumption.

Figure 7:
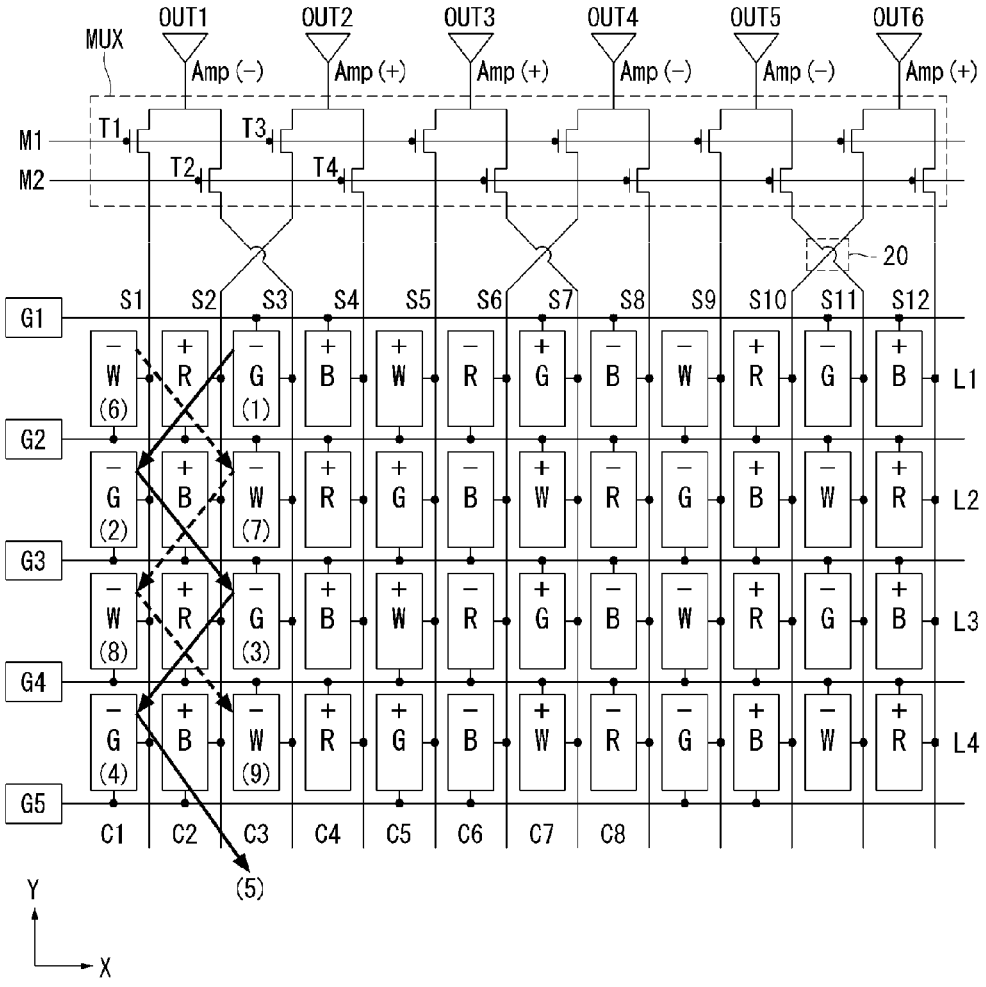
FIG. 7 is a circuit diagram illustrating a multiplexer and a pixel array according to a third embodiment of the invention.
Figure 8A:
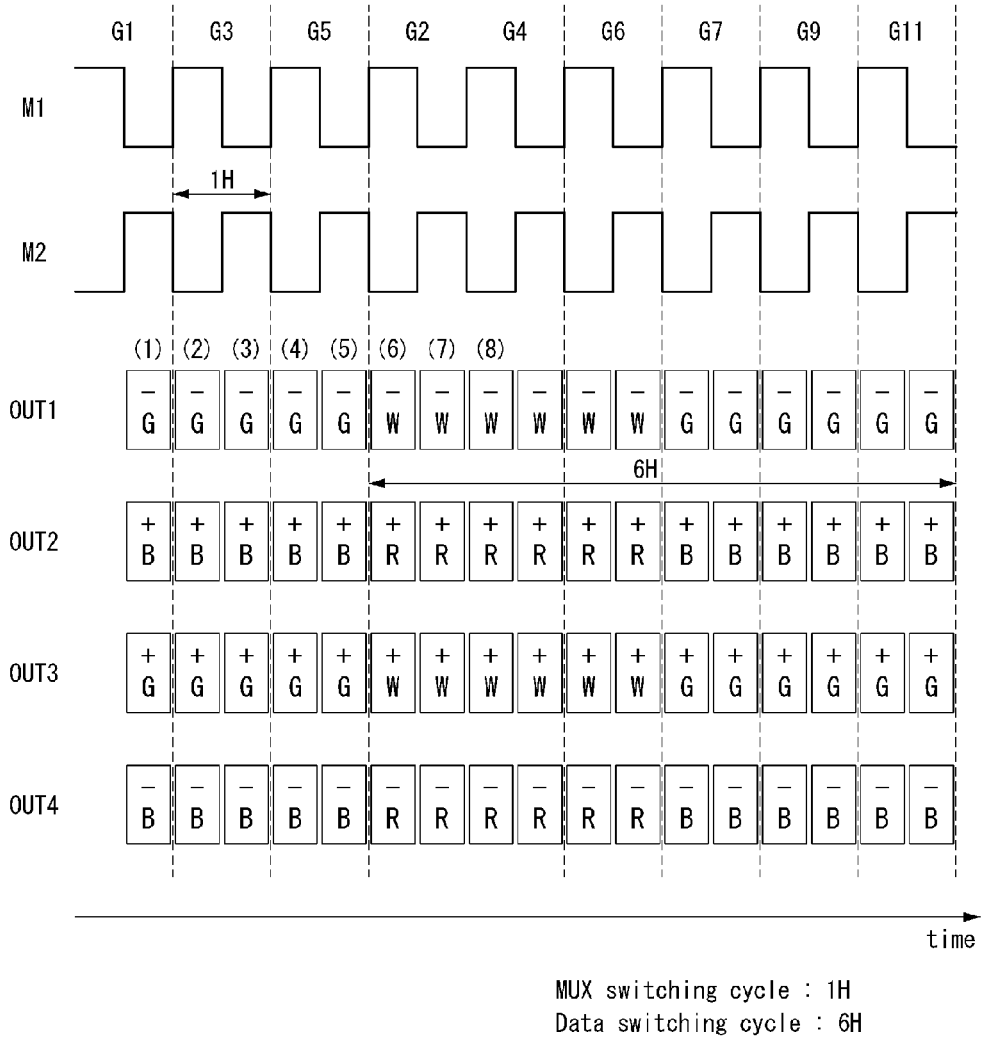
FIGS. 8A and 8B are waveform diagrams illustrating a switching cycle of the multiplexer shown in FIG. 7 and a switching cycle of data thereof.
Figure 8B:
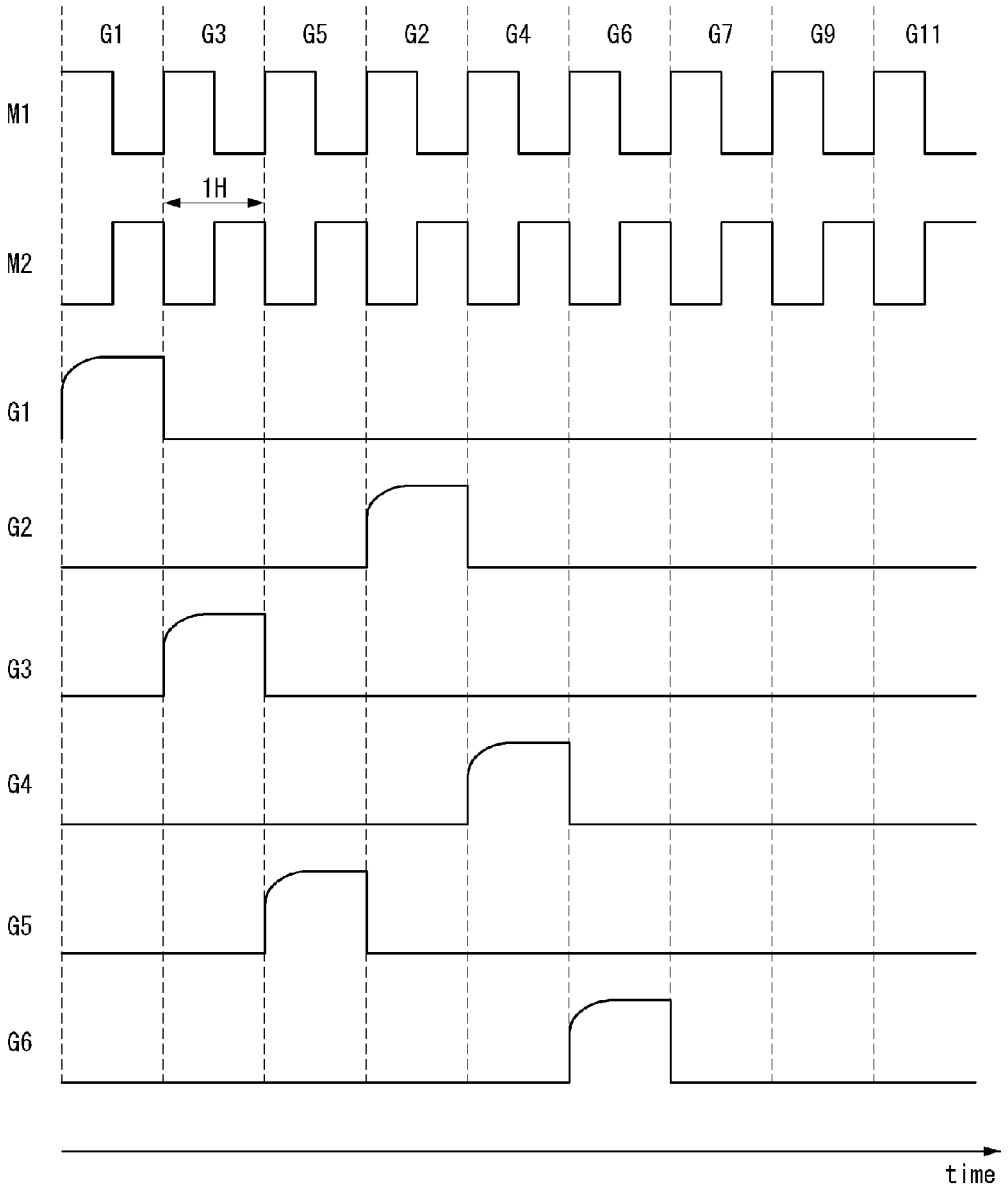

FIG. 7 is a circuit diagram illustrating a multiplexer and a pixel array according to a third exemplary embodiment of the invention. FIGS. 8A and 8B are waveform diagrams illustrating a switching cycle of the multiplexer shown in FIG. 7 and a switching cycle of data.

Referring to FIGS. 7 to 8B, the multiplexer 103 (MUX) time-divides the data voltage output from the source driver IC in response to first and second control signals M1 and M2 from the timing controller 106 and distributes the data voltages to the data lines S1 to S12. The first and second control signals M1 and M2 may be generated in antiphase with each other. A switching cycle of the first and second control signals M1 and M2 is one horizontal period 1H.

A first switch T1 is connected between a first output channel OUT1 and the first data line S1 and supplies the data voltage from the first output channel OUT1 to the first data line S1 in response to the first control signal M1. A second switch T2 is connected between the first output channel OUT1 and the third data line S3 and supplies the data voltage from the first output channel OUT1 to the third data line S3 in response to the second control signal M2. The first and second switches T1 and T2 alternately turn on.

A third switch T3 is connected between a second output channel OUT2 and the second data line S2 and supplies the data voltage from the second output channel OUT2 to the second data line S2 in response to the first control signal M1. A fourth switch T4 is connected between the second output channel OUT2 and the fourth data line S4 and supplies the data voltage from the second output channel OUT2 to the fourth data line S4 in response to the second control signal M2. The third and fourth switches T3 and T4 alternately turn on.

The second and third switches T2 and T3 and the second and third data lines S2 and S3 are connected crosswise. For this, link lines 20 connecting the second and third switches T2 and T3 to the second and third data lines S2 and S3 cross each other with an insulating layer interposed therebetween.

On odd-numbered horizontal lines L1 and L3 of a pixel array, colors of subpixels are arranged from the left in order of W, R, G, and B. On even-numbered horizontal lines L2 and L4 of the pixel array, colors of subpixels are arranged from the left in order of G, B, W, and R. On a first vertical line C1, colors of subpixels are arranged from the upper side in order of W, G, W, and G. On a second vertical line C2, colors of subpixels are arranged from the upper side in order of R, B, R, and B. On a third vertical line C3, colors of subpixels are arranged from the upper side in order of G, W, G, and W. On a fourth vertical line C4, colors of subpixels are arranged from the upper side in order of B, R, B, and R. The pixel structure and the color arrangement of the first to fourth vertical lines C1 to C4 are substantially the same as fifth to eighth vertical lines C5 to C8. Polarities of the subpixels on the first to fourth vertical lines C1 to C4 are opposite to polarities of subpixels on the fifth to eighth vertical lines C5 to C8.

On the first horizontal line L1, a first subpixel −W is connected to the second gate line G2 and the first data line S1 and receives the data voltage from the first data line S1 in response to the gate pulse from the second gate line G2. A second subpixel +R is connected to the second gate line G2 and the second data line S2 and receives the data voltage from the second data line S2 in response to the gate pulse from the second gate line G2. A third subpixel −G is connected to the first gate line G1 and the third data line S3 and receives the data voltage from the third data line S3 in response to the gate pulse from the first gate line G1. A fourth subpixel +B is connected to the first gate line G1 and the fourth data line S4 and receives the data voltage from the fourth data line S4 in response to the gate pulse from the first gate line G1.

On the second horizontal line L2, a first subpixel −G is connected to the third gate line G3 and the first data line S1 and receives the data voltage from the first data line S1 in response to the gate pulse from the third gate line G3. A second subpixel +B is connected to the third gate line G3 and the second data line S2 and receives the data voltage from the second data line S2 in response to the gate pulse from the third gate line G3. A third subpixel −W is connected to the second gate line G2 and the third data line S3 and receives the data voltage from the third data line S3 in response to the gate pulse from the second gate line G2. A fourth subpixel +R is connected to the second gate line G2 and the fourth data line S4 and receives the data voltage from the fourth data line S4 in response to the gate pulse from the second gate line G2.

As shown in FIGS. 8A and 8B, when the gate pulse is synchronized with the first and second control signals M1 and M2 and is supplied to the first to sixth gate lines G1 to G6 in order of G1, G3, G5, G2, G4, and G6, the data voltage of a first color is successively supplied to six subpixels during three horizontal periods, and then the data voltage of a second color is successively supplied to other six subpixels during next three horizontal periods. In FIGS. 7 and 8A, (1) to (9) indicate the charge order of the data voltage to the subpixels, which are controlled in the application order of the gate pulse. Thus, a switching cycle of data is six horizontal periods 6H.

Figure 9:
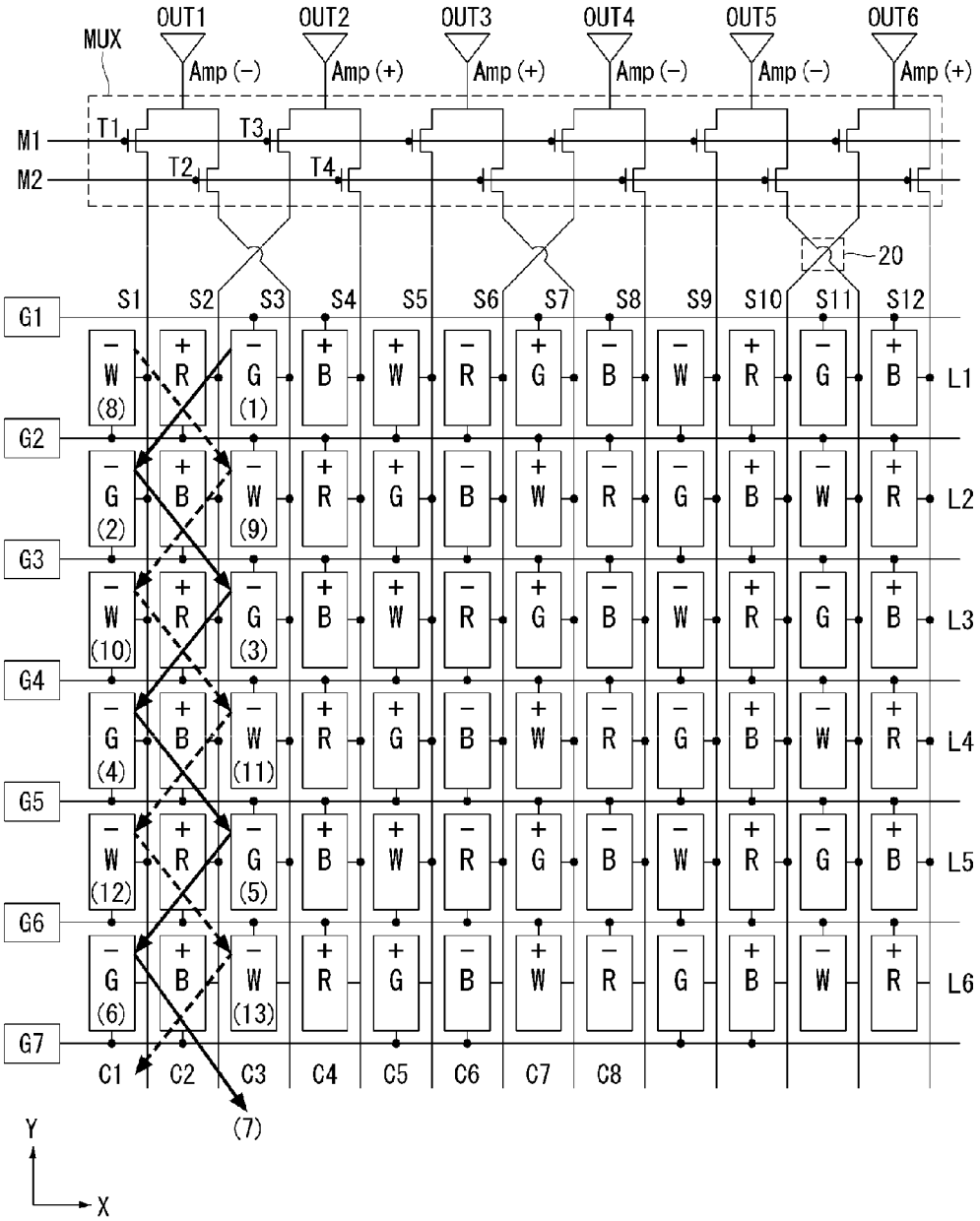
FIG. 9 is a circuit diagram illustrating a multiplexer and a pixel array according to a fourth embodiment of the invention.
Figure 10A:
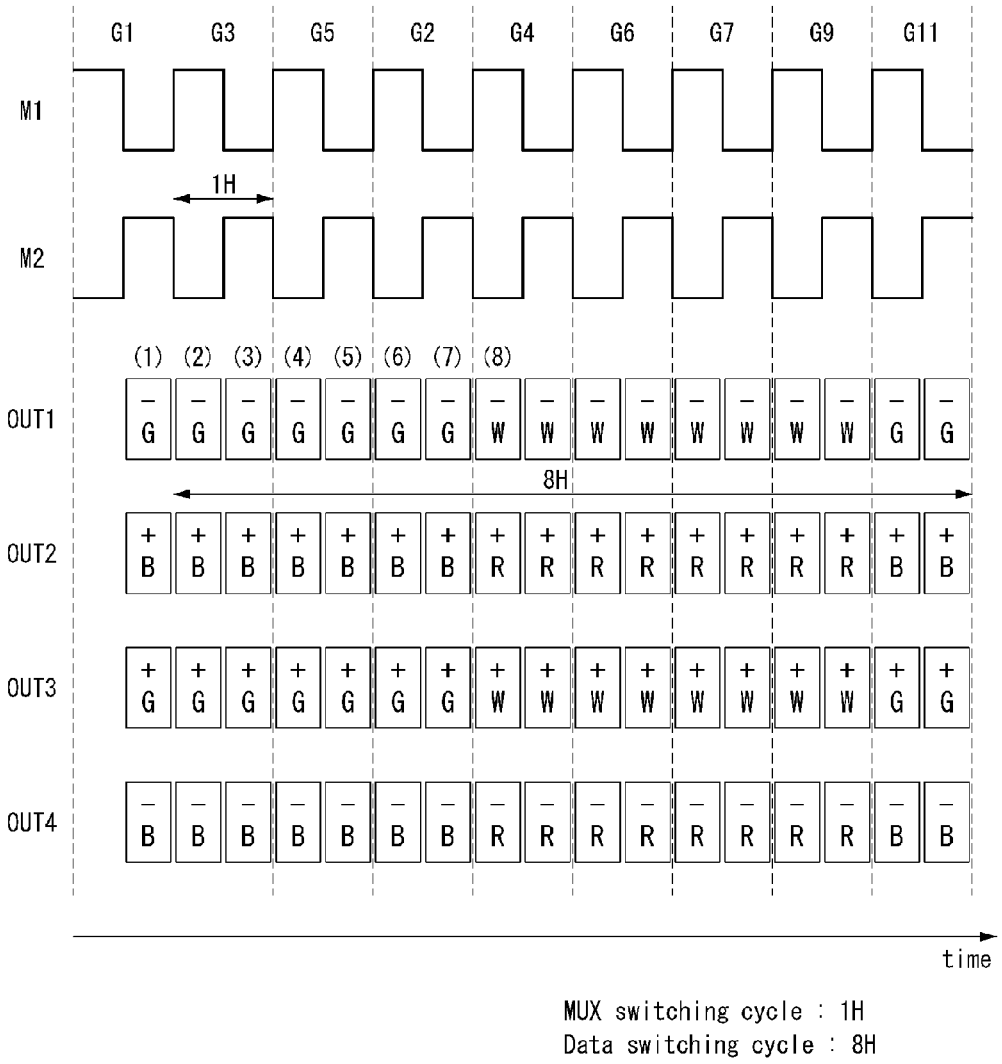
FIGS. 10A and 10B are waveform diagrams illustrating a switching cycle of the multiplexer shown in FIG. 9 and a switching cycle of data thereof.
Figure 10B:
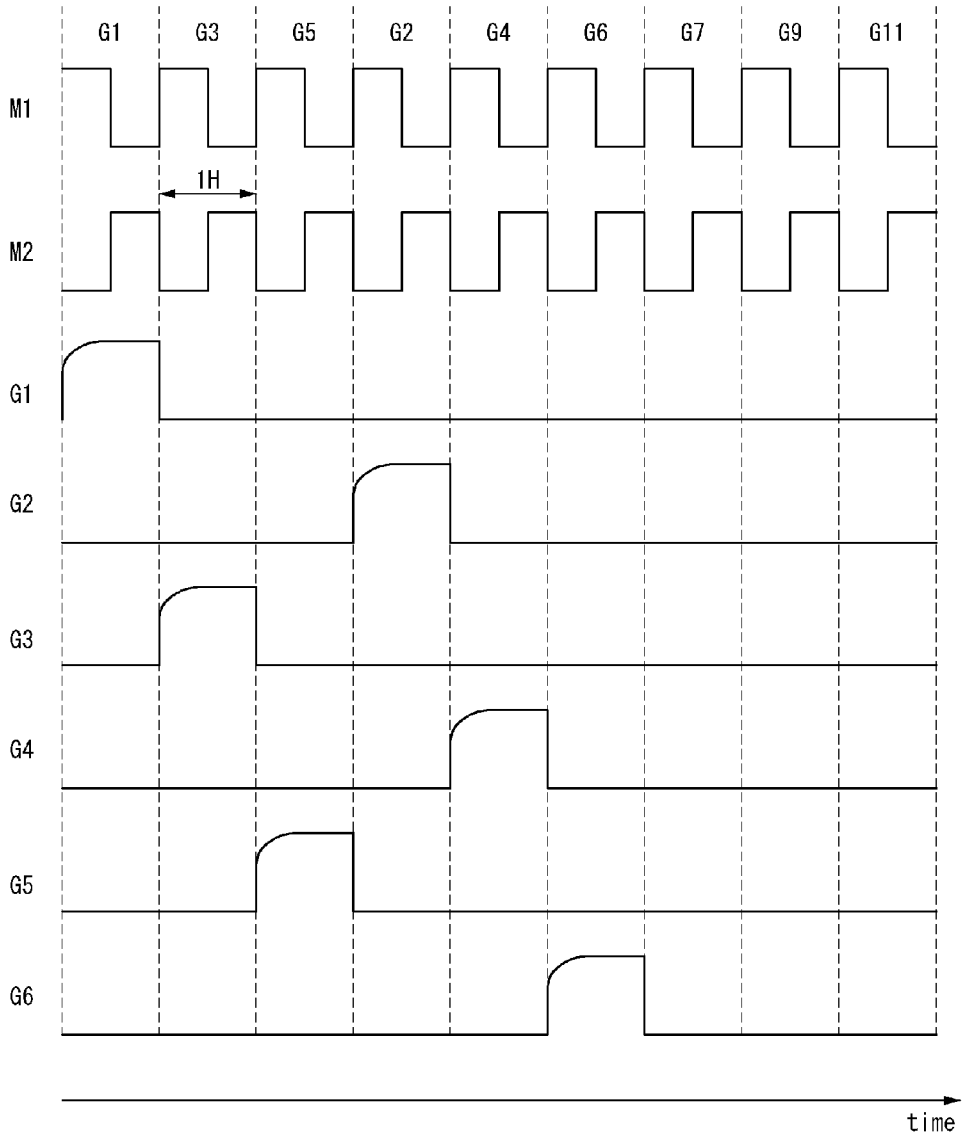

FIG. 9 is a circuit diagram illustrating a multiplexer and a pixel array according to a fourth exemplary embodiment of the invention. FIGS. 10A and 10B are waveform diagrams illustrating a switching cycle of the multiplexer shown in FIG. 9 and a switching cycle of data.

Referring to FIGS. 9 to 10B, a multiplexer 103 (MUX) time-divides the data voltage output from the source driver IC in response to first and second control signals M1 and M2 from the timing controller 106 and distributes the data voltages to the data lines S1 to S12. The first and second control signals M1 and M2 may be generated in antiphase with each other. A switching cycle of the first and second control signals M1 and M2 is one horizontal period 1H.

A first switch T1 is connected between a first output channel OUT1 and the first data line S1 and supplies the data voltage from the first output channel OUT1 to the first data line S1 in response to the first control signal M1. A second switch T2 is connected between the first output channel OUT1 and the third data line S3 and supplies the data voltage from the first output channel OUT1 to the third data line S3 in response to the second control signal M2. The first and second switches T1 and T2 alternately turn on.

A third switch T3 is connected between a second output channel OUT2 and the second data line S2 and supplies the data voltage from the second output channel OUT2 to the second data line S2 in response to the first control signal M1. A fourth switch T4 is connected between the second output channel OUT2 and the fourth data line S4 and supplies the data voltage from the second output channel OUT2 to the fourth data line S4 in response to the second control signal M2. The third and fourth switches T3 and T4 alternately turn on.

The second and third switches T2 and T3 and the second and third data lines S2 and S3 are connected crosswise. For this, link lines 20 (of FIG. 9) connecting the second and third switches T2 and T3 to the second and third data lines S2 and S3 cross each other with an insulating layer interposed therebetween.

On odd-numbered horizontal lines L1, L3, and L5 of a pixel array, colors of subpixels are arranged from the left in order of W, R, G, and B. On even-numbered horizontal lines L2, L4, and L6 of the pixel array, colors of subpixels are arranged from the left in order of G, B, W, and R. On a first vertical line C1, colors of subpixels are arranged from the upper side in order of W, G, W, and G. On a second vertical line C2, colors of subpixels are arranged from the upper side in order of R, B, R, and B. On a third vertical line C3, colors of subpixels are arranged from the upper side in order of G, W, G, and W. On a fourth vertical line C4, colors of subpixels are arranged from the upper side in order of B, R, B, and R. The pixel structure and the color arrangement of the first to fourth vertical lines C1 to C4 are substantially the same as fifth to eighth vertical lines C5 to C8. Polarities of the subpixels on the first to fourth vertical lines C1 to C4 are opposite to polarities of subpixels on the fifth to eighth vertical lines C5 to C8.

On the first horizontal line L1, a first subpixel −W is connected to the second gate line G2 and the first data line S1 and receives the data voltage from the first data line S1 in response to the gate pulse from the second gate line G2. A second subpixel +R is connected to the second gate line G2 and the second data line S2 and receives the data voltage from the second data line S2 in response to the gate pulse from the second gate line G2. A third subpixel −G is connected to the first gate line G1 and the third data line S3 and receives the data voltage from the third data line S3 in response to the gate pulse from the first gate line G1. A fourth subpixel +B is connected to the first gate line G1 and the fourth data line S4 and receives the data voltage from the fourth data line S4 in response to the gate pulse from the first gate line G1.

On the second horizontal line L2, a first subpixel −G is connected to the third gate line G3 and the first data line S1 and receives the data voltage from the first data line S1 in response to the gate pulse from the third gate line G3. A second subpixel +B is connected to the third gate line G3 and the second data line S2 and receives the data voltage from the second data line S2 in response to the gate pulse from the third gate line G3. A third subpixel −W is connected to the second gate line G2 and the third data line S3 and receives the data voltage from the third data line S3 in response to the gate pulse from the second gate line G2. A fourth subpixel +R is connected to the second gate line G2 and the fourth data line S4 and receives the data voltage from the fourth data line S4 in response to the gate pulse from the second gate line G2.

As shown in FIGS. 10A and 10B, when the gate pulse is synchronized with the first and second control signals M1 and M2 and is supplied to the first to seventh and ninth gate lines G1 to G7 and G9 in order of G1, G3, G5, G2, G4, G6, G7, and G9, the data voltage of a first color is successively supplied to eight subpixels during four horizontal periods, and then the data voltage of a second color is successively supplied to other eight subpixels during next four horizontal periods. The gate pulse is supplied to the eighth gate line G8 and the gate lines following the ninth gate line G9 in order of G11, G8, G10, G12, G13, G15, and G17. In FIGS. 9 and 10A, (1) to (13) indicate the charge order of the data voltage to the subpixels, which are controlled in the application order of the gate pulse. Thus, a switching cycle of data is eight horizontal periods 8H.

Figure 11:
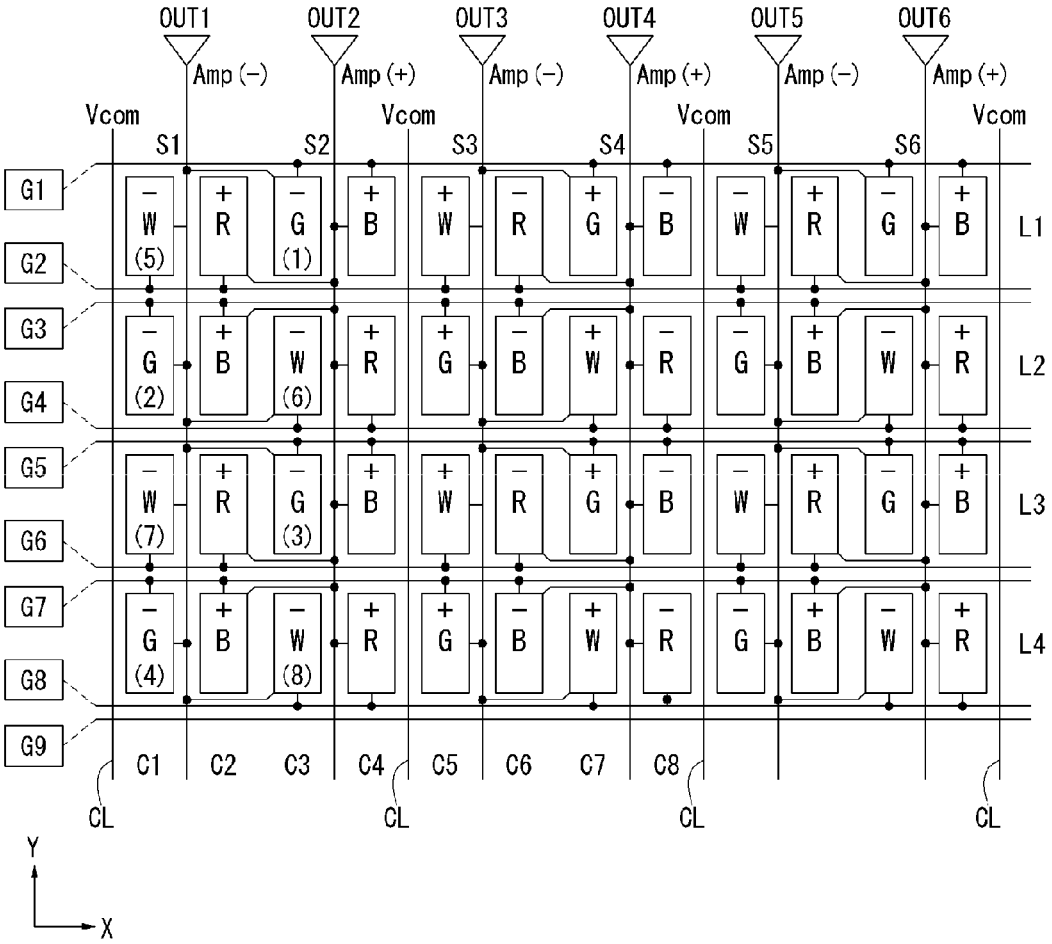
FIG. 11 is a circuit diagram illustrating a pixel array according to a fifth embodiment of the invention.

In a DRD (double rate driving) type pixel array shown in FIG. 11, because two subpixels, which are adjacent to each other along a horizontal axis (i.e., x-axis), share one data line with each other, the number of source driver ICs is reduced without the multiplexer. In other words, even when the DRD type pixel array is connected to the source driver ICs without the multiplexer, the number of source driver ICs can decrease.

FIG. 11 is a circuit diagram illustrating a pixel array according to a fifth exemplary embodiment of the invention.

Figure 12:
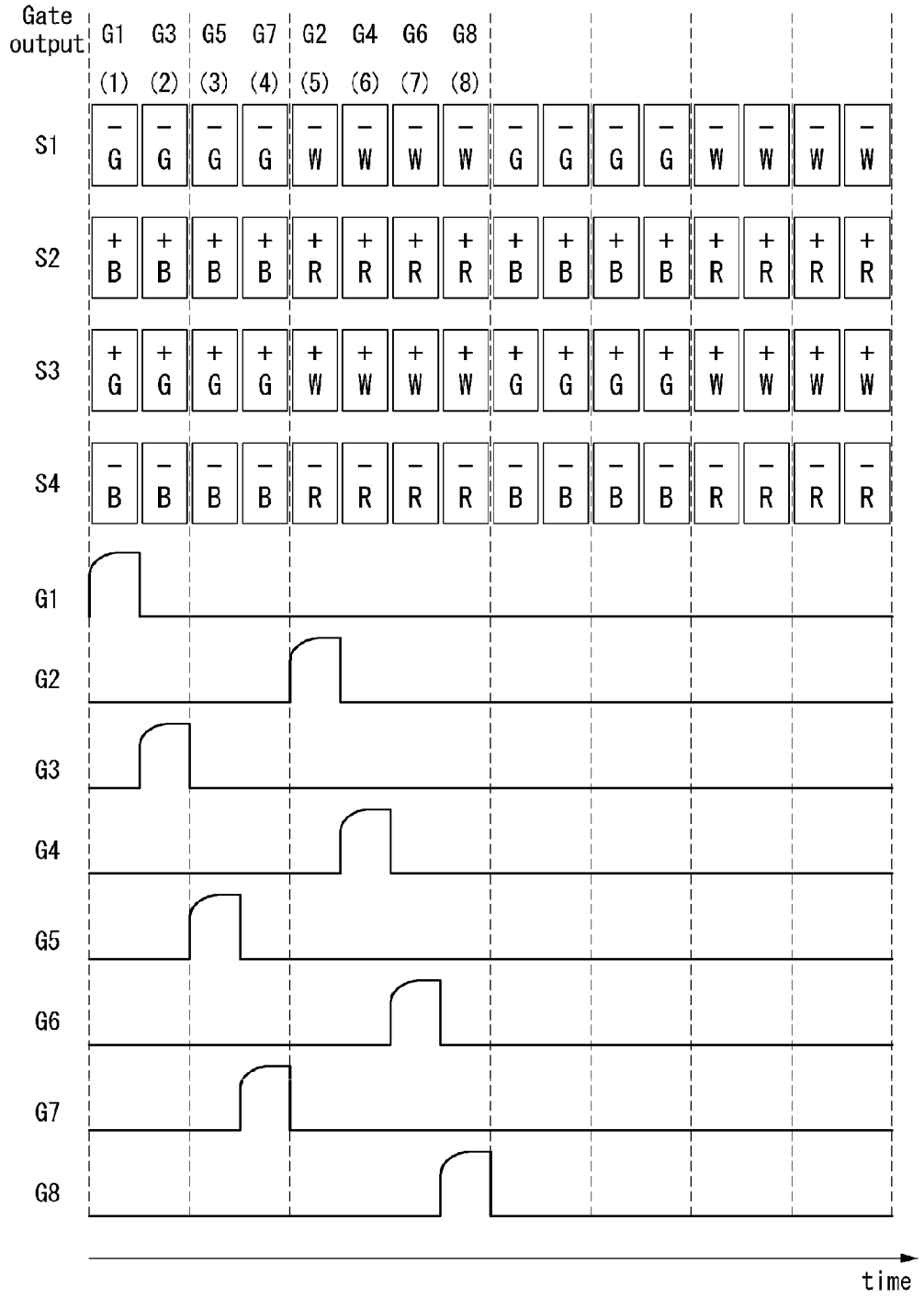
FIG. 12 is a waveform diagram illustrating a data voltage and a gate pulse supplied to the pixel array shown in FIG. 11.

FIG. 12 is a waveform diagram illustrating a data voltage and a gate pulse supplied to the pixel array shown in FIG. 11.

Referring to FIGS. 11 and 12, the source driver ICs are connected to the data lines S1 to S6 without the multiplexer. The source driver ICs may maintain a polarity of the data voltage applied to the data lines during one frame period and then may invert the polarity of the data voltage in each frame. For example, a polarity of the data voltage supplied through the first data line is maintained at a first polarity during a first frame period and then is inverted into a second polarity during a second frame period. Thus, the data voltage is maintained at the same polarity during one frame period. A polarity of the data voltage supplied through the second data line is maintained at the second polarity during the first frame period and then is inverted into the first polarity during the second frame period. That is, the data voltage is maintained at the same polarity during one frame period.

On each of horizontal lines L1 to L4, first and third subpixels are connected to the first data line S1 and share the first data line S1 with each other. The first and third subpixels are successively charged to the data voltage supplied through the first data line S1. Second and fourth subpixels are connected to the second data line S2 and share the second data line S2 with each other. The second and fourth subpixels are successively charged to the data voltage supplied through the second data line S2. Thus, the pixel array shown in FIG. 11 has the structure in which two subpixels, which are horizontally adjacent to each other with one subpixel interposed therebetween, share one data line with each other. As a result, the number of data lines on one horizontal line may be less than the number of subpixels disposed on the one horizontal line. A vertical common line CL may be disposed along a space, in which the data lines are not disposed. The common voltage Vcom may be supplied to all of the subpixels through the vertical common lines CL.

On the odd-numbered horizontal lines L1 and L3 of the pixel array, colors of subpixels are arranged from the left in order of W, R, G, and B. On the even-numbered horizontal lines L2 and L4 of the pixel array, colors of subpixels are arranged from the left in order of G, B, W, and R. On a first vertical line C1, colors of subpixels are arranged from the upper side in order of W, G, W, and G. On a second vertical line C2, colors of subpixels are arranged from the upper side in order of R, B, R, and B. On a third vertical line C3, colors of subpixels are arranged from the upper side in order of G, W, G, and W. On a fourth vertical line C4, colors of subpixels are arranged from the upper side in order of B, R, B, and R. The pixel structure and the color arrangement of the first to fourth vertical lines C1 to C4 are substantially the same as fifth to eighth vertical lines C5 to C8. Polarities of the subpixels on the first to fourth vertical lines C1 to C4 are opposite to polarities of subpixels on the fifth to eighth vertical lines C5 to C8.

On the first horizontal line L1, a first subpixel −W is connected to the second gate line G2 and the first data line S1 and receives the data voltage from the first data line S1 in response to the gate pulse from the second gate line G2. A second subpixel +R is connected to the second gate line G2 and the second data line S2 and receives the data voltage from the second data line S2 in response to the gate pulse from the second gate line G2. A third subpixel −G is connected to the first gate line G1 and the first data line S1 and receives the data voltage from the first data line S1 in response to the gate pulse from the first gate line G1. A fourth subpixel +B is connected to the first gate line G1 and the second data line S2 and receives the data voltage from the second data line S2 in response to the gate pulse from the first gate line G1. The second subpixel +R is positioned between the first and third subpixels −W and −G. The third subpixel −G is positioned between the second and fourth subpixels +R and +B.

On the second horizontal line L2, a first subpixel −G is connected to the third gate line G3 and the first data line S1 and receives the data voltage from the first data line S1 in response to the gate pulse from the third gate line G3. A second subpixel +B is connected to the third gate line G3 and the second data line S2 and receives the data voltage from the second data line S2 in response to the gate pulse from the third gate line G3. A third subpixel −W is connected to the fourth gate line G4 and the first data line S1 and receives the data voltage from the first data line S1 in response to the gate pulse from the fourth gate line G4. A fourth subpixel +R is connected to the fourth gate line G4 and the second data line S2 and receives the data voltage from the second data line S2 in response to the gate pulse from the fourth gate line G4. The second subpixel +B is positioned between the first and third subpixels −G and −W. The third subpixel −W is positioned between the second and fourth subpixels +B and +R.

As shown in FIG. 12, when the gate pulse is supplied to the first to eighth gate lines G1 through G8 in order of G1, G3, G5, G7, G2, G4, G6, and G8, the data voltage of a first color is successively supplied to four subpixels during two horizontal periods, and then the data voltage of a second color is successively supplied to other four subpixels during next two horizontal periods. In FIGS. 11 and 12, (1) through (8) indicate the charge order of the data voltage to the subpixels, which are controlled in the application order of the gate pulse. Thus, a switching cycle of data is four horizontal periods 4H.

Figure 13:
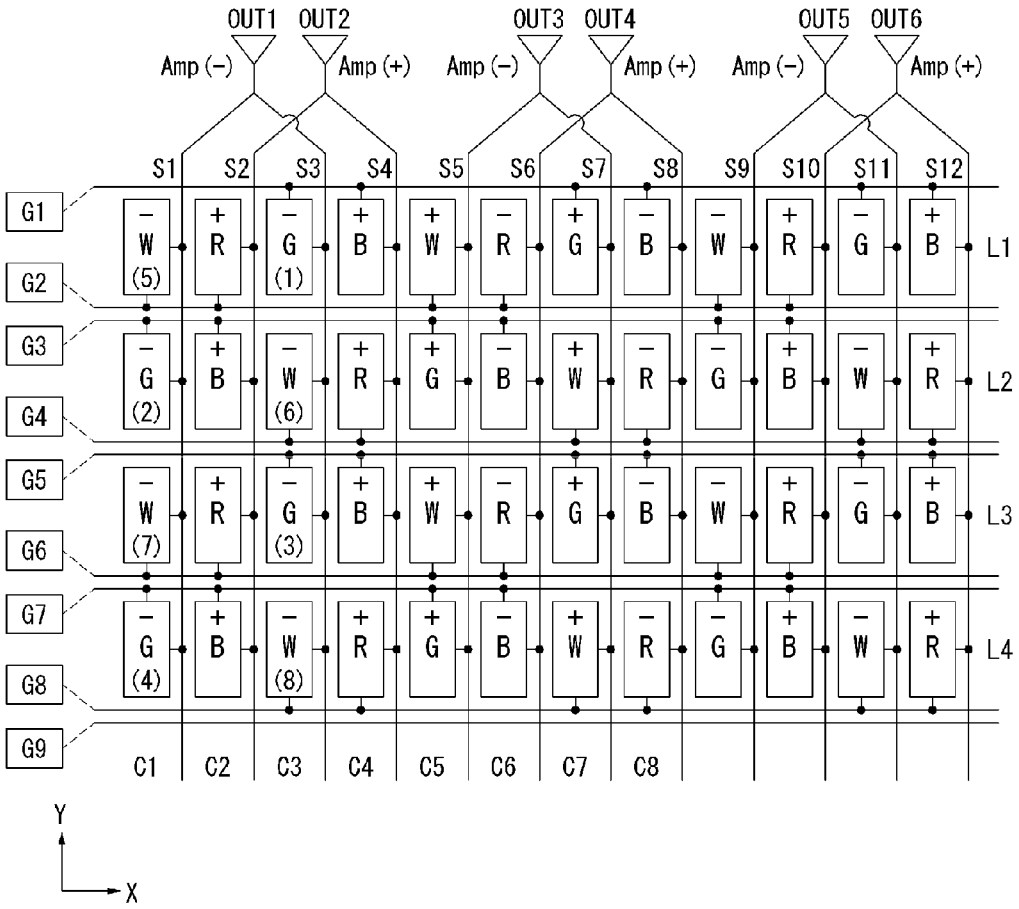
FIG. 13 is a circuit diagram illustrating a pixel array according to a sixth embodiment of the invention.

In a pixel array shown in FIG. 13, two data line are connected to one output channel of the source driver IC, and thus the number of source driver ICs is decreased without the multiplexer.

Figure 14:
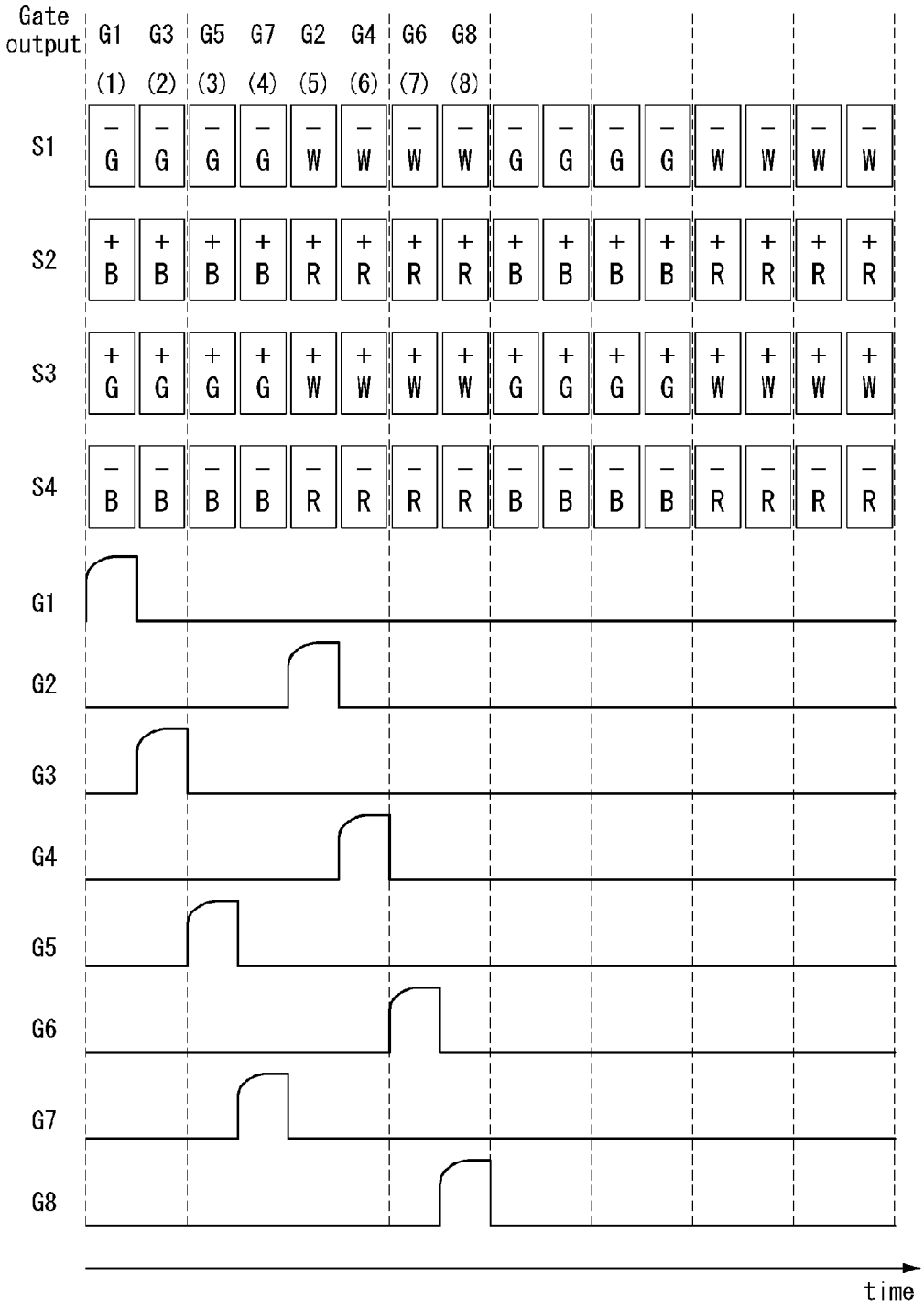
FIG. 14 is a waveform diagram illustrating a data voltage and a gate pulse supplied to the pixel array shown in FIG. 13.

FIG. 13 is a circuit diagram illustrating a pixel array according to a sixth exemplary embodiment of the invention. FIG. 14 is a waveform diagram illustrating a data voltage and a gate pulse supplied to the pixel array shown in FIG. 13.

Referring to FIGS. 13 and 14, the source driver ICs are connected to the data lines S1 to S12 without the multiplexer. The source driver ICs may maintain a polarity of the data voltage applied to the data lines during one frame period and then may invert the polarity of the data voltage in each frame. For example, a polarity of the data voltage supplied through the first data line is maintained at a first polarity during a first frame period and then is inverted into a second polarity during a second frame period. Thus, the data voltage is maintained at the same polarity during one frame period. A polarity of the data voltage supplied through the second data line is maintained at the second polarity during the first frame period and then is inverted into the first polarity during the second frame period. That is, the data voltage is maintained at the same polarity during one frame period.

A first output channel OUT1 of the source driver IC is connected to the first and third data lines S1 and S3 of the pixel array. A second output channel OUT2 of the source driver IC is connected to the second and fourth data lines S2 and S4 of the pixel array. Thus, the number of output channels of the source driver IC may decrease compared to the number of subpixels disposed on the horizontal line without the multiplexer.

On odd-numbered horizontal lines L1 and L3 of the pixel array, colors of subpixels are arranged from the left in order of W, R, G, and B. On even-numbered horizontal lines L2 and L4 of the pixel array, colors of subpixels are arranged from the left in order of G, B, W, and R. On a first vertical line C1, colors of subpixels are arranged from the upper side in order of W, G, W, and G. On a second vertical line C2, colors of subpixels are arranged from the upper side in order of R, B, R, and B. On a third vertical line C3, colors of subpixels are arranged from the upper side in order of G, W, G, and W. On a fourth vertical line C4, colors of subpixels are arranged from the upper side in order of B, R, B, and R. The pixel structure and the color arrangement of the first to fourth vertical lines C1 to C4 are substantially the same as fifth to eighth vertical lines C5 to C8. Polarities of the subpixels on the first to fourth vertical lines C1 to C4 are opposite to polarities of subpixels on the fifth to eighth vertical lines C5 to C8.

On the first horizontal line L1, a first subpixel −W is connected to the second gate line G2 and the first data line S1 and receives the data voltage from the first data line S1 in response to the gate pulse from the second gate line G2. A second subpixel +R is connected to the second gate line G2 and the second data line S2 and receives the data voltage from the second data line S2 in response to the gate pulse from the second gate line G2. A third subpixel −G is connected to the first gate line G1 and the third data line S3 and receives the data voltage from the third data line S3 in response to the gate pulse from the first gate line G1. A fourth subpixel +B is connected to the first gate line G1 and the fourth data line S4 and receives the data voltage from the fourth data line S4 in response to the gate pulse from the first gate line G1.

On the second horizontal line L2, a first subpixel −G is connected to the third gate line G3 and the first data line S1 and receives the data voltage from the first data line S1 in response to the gate pulse from the third gate line G3. A second subpixel +B is connected to the third gate line G3 and the second data line S2 and receives the data voltage from the second data line S2 in response to the gate pulse from the third gate line G3. A third subpixel −W is connected to the fourth gate line G4 and the third data line S3 and receives the data voltage from the third data line S3 in response to the gate pulse from the fourth gate line G4. A fourth subpixel +R is connected to the fourth gate line G4 and the fourth data line S4 and receives the data voltage from the fourth data line S4 in response to the gate pulse from the fourth gate line G4.

As shown in FIG. 14, when the gate pulse is supplied to the first to eighth gate lines G1 through G8 in order of G1, G3, G5, G7, G2, G4, G6, and G8, the data voltage of a first color is successively supplied to four subpixels during two horizontal periods, and then the data voltage of a second color is successively supplied to the other four subpixels during the next two horizontal periods. In FIGS. 13 and 14, (1) through (8) indicate the charge order of the data voltage to the subpixels, which are controlled in the application order of the gate pulse. Thus, a switching cycle of data is four horizontal periods 4H.

As described above, the display device according to the exemplary embodiments of the invention connects the multiplexer to the source driver IC of the data driver, causes two subpixels to share one data line with each other, or causes two data lines to share one output channel of the source driver IC with each other, thereby reducing the number of source driver ICs. Further, the exemplary embodiments of the invention increase the switching cycle of the multiplexer or increase the switching cycle of data, thereby reducing the power consumption.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

It will be apparent to those skilled in the art that various modifications and variations can be made in the liquid crystal display of the present invention without departing from the spirit or scope of the invention. Thus, it is intended that the present invention cover the modifications and variations of this invention provided they come within the scope of the appended claims and their equivalents.

What is claimed is:

1. A display device comprising:

a pixel array including a plurality of subpixels arranged in a matrix form based on a crossing structure of data lines and gate lines, the subpixels including at least subpixels of a first color and subpixels of a second color different from the first color;

a data driver including a plurality of output channels to output data voltages, respectively;

a multiplexer connected between the pixel array and the data driver, and configured to distribute the data voltages output from the data driver to the data lines, respectively, in response to first and second control signals from a controller; and a gate driver connected to the pixel array, and configured to output gate pulse synchronized with the data voltages to the gate lines in a non-sequential manner, wherein the first and second control signals are in anti-phase with each other, and a switching cycle of the first and second control signals is one horizontal period or two horizontal periods, wherein a data switching cycle of the data voltages supplied to the pixel array is N horizontal periods, where N is a positive even number greater than or equal to 4, and wherein the data driver is configured to provide data voltages of the first color successively to N subpixels of the first color via one of the output channels within N/2 successive horizontal periods.

2. The display device of claim 1, wherein the multiplexer includes:

a first switch connected between a first output channel of the data driver and a first data line and configured to supply a data voltage from the first output channel to the first data line in response to the first control signal;

a second switch connected between the first output channel and a third data line and configured to supply the data voltage from the first output channel to the third data line response to the second control signal;

a third switch connected between a second output channel of the data driver and a second data line and configured to supply a data voltage from the second output channel to the second data line in response to the first control signal; and a fourth switch connected between the second output channel and a fourth data line and configured to supply the data voltage from the second output channel to the fourth data line in response to the second control signal, wherein the switching cycle of the first and second control signals is one horizontal period, wherein the gate pulse is supplied to the gate lines in order of a first gate line, a third gate line, a second gate line, and a fourth gate line, and wherein the data voltages of the first color are configured to be successively supplied to four subpixels of the first color via the one of the output channels during two successive horizontal periods, and then data voltages of the second color are configured to be successively supplied to four subpixels of the second color via the one of the output channels during next two successive horizontal periods.

3. The display device of claim 1, wherein the multiplexer includes:

a first switch connected between a first output channel of the data driver and a first data line and configured to supply a data voltage from the first output channel to the first data line in response to the first control signal;

a second switch connected between the first output channel and a third data line and configured to supply the data voltage from the first output channel to the third data line in response to the second control signal;

a third switch connected between a second output channel of the data driver and a second data line and configured to supply a data voltage from the second output channel to the second data line in response to the first control signal; and a fourth switch connected between the second output channel and a fourth data line and configured to supply the data voltage from the second output channel to the fourth data line in response to the second control signal, wherein the switching cycle of the first and second control signals is two horizontal periods, wherein the gate pulse is supplied to the gate lines in order of a first gate line, a third gate line, a second gate line, and a fourth gate line, and wherein the data voltages of the first color are configured to be successively supplied to four subpixels of the first color via the one of the output channels during two successive horizontal periods, and then data voltages of the second color are configured to be successively supplied to four subpixels of the second color via the one of the output channels during next two successive horizontal periods.

4. The display device of claim 1, wherein the multiplexer includes:

a first switch connected between a first output channel of the data driver and a first data line and configured to supply a data voltage from the first output channel to the first data line in response to the first control signal;

a second switch connected between the first output channel and a third data line and configured to supply the data voltage from the first output channel to the third data line in response to the second control signal;

a third switch connected between a second output channel of the data driver and a second data line and configured to supply a data voltage from the second output channel to the second data line in response to the first control signal; and a fourth switch connected between the second output channel and a fourth data line and configured to supply the data voltage from the second output channel to the fourth data line in response to the second control signal, wherein the switching cycle of the first and second control signals is one horizontal period, wherein the gate pulse is supplied to the gate lines in order of a first gate line, a third gate line, a fifth gate line, a second gate line, a fourth gate line, and a sixth gate line, and wherein the data voltages of the first color are configured to be successively supplied to six subpixels of the first color via the one of the output channels during three successive horizontal periods, and then data voltages of the second color are configured to be successively supplied to six subpixels of the second color via the one of the output channels during next three successive horizontal periods.

5. The display device of claim 1, wherein the multiplexer includes:

a first switch connected between a first output channel of the data driver and a first data line and configured to supply a data voltage from the first output channel to the first data line in response to the first control signal;

a second switch connected between the first output channel and a third data line and configured to supply the data voltage from the first output channel to the third data line in response to the second control signal;

a third switch connected between a second output channel of the data driver and a second data line and configured to supply a data voltage from the second output channel to the second data line in response to the first control signal; and a fourth switch connected between the second output channel and a fourth data line and configured to supply the data voltage from the second output channel to the fourth data line in response to the second control signal, wherein the switching cycle of the first and second control signals is one horizontal period, wherein the gate pulse is supplied to the gate lines in order of a first gate line, a third gate line, a fifth gate line, a second gate line, a fourth gate line, a sixth gate line, a seventh gate line, and a ninth gate line, and wherein the data voltages of the first color are configured to be successively supplied to eight subpixels of the first color via the one of the output channels during four successive horizontal periods, and then data voltages of the second color are configured to be successively supplied to eight subpixels of the second color via the one of the output channels during next four successive horizontal periods.

6. The display device of claim 1, wherein the N subpixels of the first color are arranged in at least two columns separated by another column of subpixels.

7. A display device comprising:

a pixel array including a plurality of subpixels arranged in a matrix form based on a crossing structure of data lines and gate lines, the subpixels including at least subpixels of a first color and subpixels of a second color different from the first color;

a data driver including a plurality of output channels and configured to output data voltages to the data lines, respectively, through the plurality of output channels; and a gate driver configured to output a gate pulse synchronized with the data voltage to the gate lines in a non-sequential manner, wherein a data switching cycle of the data voltages supplied to the pixel array is N horizontal periods, where N is a positive integer greater than or equal to 4, and wherein the data driver is configured to provide data voltages of the first color successively to at least four subpixels of the first color via one of the output channels, the data driver being configured to provide the data voltages of the first color to the four subpixels of the first color within two horizontal periods.

8. The display device of claim 7, wherein in the pixel array, first and third subpixels are connected to a first data line with a second subpixel interposed therebetween, wherein the second subpixel and a fourth subpixel are connected to a second data line, wherein the gate pulse is supplied to the gate lines in order of a first gate line, a third gate line, a fifth gate line, a seventh gate line, a second gate line, a fourth gate line, a sixth gate line, and an eighth gate line, and wherein data voltages of the second color are configured to be successively supplied to four subpixels of the second color during next two horizontal periods following the two horizontal periods.

9. The display device of claim 7, wherein a first output channel of the data driver is connected to first and third data lines with a second data line disposed between the first data line and the third data line, wherein a second output channel of the data driver is connected to the second data line and a fourth data line, wherein the gate pulse is supplied to the gate lines in order of a first gate line, a third gate line, a fifth gate line, a seventh gate line, a second gate line, a fourth gate line, a sixth gate line, and an eighth gate line, and wherein the data voltages of the first color are configured to be successively supplied to the four subpixels of the first color via the one of the output channels during two horizontal periods, and then data voltages of the second color are configured to be successively supplied to four subpixels of the second color via the one of the output channels during next two horizontal periods.

10. The display device of claim 7, wherein the at least four subpixels of the first color are arranged in at least two columns separated by another column of subpixels.

11. A display device, comprising:

a pixel array including a plurality of data lines, a plurality of gate lines, and a plurality of subpixels arranged in a matrix form based on crossings of the data lines and the gate lines, the subpixels including at least subpixels of a first color and subpixels of a second color different from the first color;

a data driver configured to provide data voltages to the data lines respectively through a plurality of output channels; and a gate driver configured to provide a gate pulse synchronized with the data voltages to the gate lines, wherein a data switching cycle of the data voltages provided to the pixel array is N horizontal periods, where N is a positive integer greater than or equal to 4, and wherein the data driver is configured to provide data voltages of the first color successively to at least four subpixels of the first color via one of the output channels in the data switching cycle, the data driver being configured to provide the data voltages of the first color to the four subpixels of the first color within two horizontal periods in the data switching cycle.

12. The display device of claim 11; wherein the at least four subpixels of the first color are arranged in at least two columns separated by another column of subpixels.

13. The display device of claim 11, wherein the data driver is configured to provide data voltages of the second color successively to at least four subpixels of the second color via the one of the output channels in the data switching cycle, the data driver being configured to provide the data voltages of the second color to the four subpixels of the second color within two subsequent horizontal periods in the data switching cycle.

14. The display device of claim 11, wherein the gate lines include in order a first gate line, a second gate line, and a third gate line, the second gate line being disposed between the first and the third gate lines, and wherein the gate driver is configured to provide the gate pulse in a non-sequential manner so as to provide the gate pulse to the first gate line and then to the third gate line before providing the gate pulse to the second gate line during the data switching cycle.

15. The display device of claim 11, further comprising:

a multiplexer configured to receive the data voltages from the output channels of the data driver and to selectively provide the data voltages to the respective data lines based on a first control signal and a second control signal from a controller.

16. The display device of claim 15, wherein the data lines include in order a first data line, a second data line, and a third data line, the second data line being disposed between the first and the third data lines, wherein the multiplexer includes:

a first switch connected between a first output channel of the data driver and the first data line and configured to provide a data voltage from the first output channel to the first data line in response to the first control signal; and a second switch connected between the first output channel and the third data line and configured to provide the data voltage from the first output channel to the third data line in response to the second control signal, and wherein the first and the second control signals are in antiphase with each other.

17. The display device of claim 16, wherein a switching cycle of the first and the second control signals is one horizontal period or two horizontal periods.

18. The display device of claim 11, wherein each of the output channels of the data driver is connected to a respective one of the data lines and is configured to provide a data voltage to the respective one of the data lines, wherein the pixel array includes in order a first column of subpixels, a second column of subpixels, and a third column of subpixels, the second column of subpixels being disposed between the first column and the third column of subpixels, and wherein the first column and the third column of subpixels are connected to one of the data lines, and the second column of subpixels is connected to another one of the data lines.

19. The display device of claim 11, wherein each of the output channels of the data driver is connected respectively to at least two of the data lines and is configured to provide data voltages respectively to the at least two of the data lines, wherein the data lines include in order a first data line, a second data line, and a third data line, the second data line being disposed between the first and the third data lines, and wherein the first and the third data lines are connected to the one of the output channels of the data driver, and the second data line is connected to another one of the output channels of the data driver.

* * * * *